US010031465B2

(12) United States Patent
Sunaoshi et al.

(10) Patent No.: US 10,031,465 B2
(45) Date of Patent: Jul. 24, 2018

(54) SHEET BINDING DEVICE, SHEET POST-PROCESSING DEVICE, AND IMAGE FORMING APPARATUS

(71) Applicants: KABUSHIKI KAISHA TOSHIBA, Tokyo (JP); TOSHIBA TEC KABUSHIKI KAISHA, Tokyo (JP)

(72) Inventors: Takamitsu Sunaoshi, Yokohama Kanagawa (JP); Misato Ishikawa, Kawasaki Kanagawa (JP); Takahiro Kokubo, Kamakura Kanagawa (JP); Shunsuke Hattori, Kawasaki Kanagawa (JP); Kikuo Mizutani, Izu Shizuoka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/439,737

(22) Filed: Feb. 22, 2017

(65) Prior Publication Data

US 2018/0150016 A1 May 31, 2018

(30) Foreign Application Priority Data

Nov. 25, 2016 (JP) ..... 2016-229574

(51) Int. Cl.
*G03G 15/00* (2006.01)
*B65H 37/04* (2006.01)

(52) U.S. Cl.
CPC ..... *G03G 15/6541* (2013.01); *B65H 37/04* (2013.01); *B65H 2301/516* (2013.01); *B65H 2801/27* (2013.01)

(58) Field of Classification Search
CPC ..... G03G 15/6541
(Continued)

(56) References Cited

U.S. PATENT DOCUMENTS 3,939,513 A * 2/1976 Crathern, III ..... B42B 5/00 412/1
5,172,179 A * 12/1992 Tani ..... B42C 1/125 100/26

(Continued)

FOREIGN PATENT DOCUMENTS

JP H07023563 5/1995
JP H10114461 A 5/1998

(Continued)

*Primary Examiner* — Anthony Nguyen
(74) *Attorney, Agent, or Firm* — Patterson & Sheridan, LLP

(57) ABSTRACT

According to one embodiment, a sheet binding device includes a tape support base, a slide base, a tape holder, a first displacement mechanism, and a second displacement mechanism. The tape support base supports a tape. The slide base is movable in a first direction. The tape holder is supported on the slide base and is movable in a second direction crossing the first direction. The first displacement mechanism displaces the tape holder in a second direction from a first position that is a position away from the tape to a second position at which the tape holder is capable of coming into contact with the tape. The second displacement mechanism displaces the tape holder in the second direction from the second position to the first position.

9 Claims, 22 Drawing Sheets

(58) Field of Classification Search
USPC ..... 399/408
See application file for complete search history.

(56) References Cited

U.S. PATENT DOCUMENTS

| | | | | |
|---|---|---|---|---|
| 5,540,421 | A * | 7/1996 | Ohta | B42C 1/12 270/58.09 |
| 7,597,312 | B2 | 10/2009 | Nishioka | |
| 2004/0247356 | A1* | 12/2004 | Kaneko | B42C 1/12 399/407 |
| 2010/0119332 | A1* | 5/2010 | Ozawa | B41J 3/44 412/1 |
| 2010/0194023 | A1* | 8/2010 | Ozawa | B42B 4/00 270/58.08 |
| 2014/0308093 | A1* | 10/2014 | Ishikawa | B42C 5/00 412/16 |
| 2016/0031200 | A1 | 2/2016 | Taki et al. | |

FOREIGN PATENT DOCUMENTS

| | | | |
|---|---|---|---|
| JP | 2007119206 | A | 5/2007 |
| JP | 2007153463 | A | 6/2007 |
| JP | 2014177056 | A | 9/2014 |
| JP | 2016030400 | A | 3/2016 |
| JP | 2016148018 | A | 8/2016 |

* cited by examiner

SHEET BINDING DEVICE, SHEET POST-PROCESSING DEVICE, AND IMAGE FORMING APPARATUS

CROSS-REFERENCE TO RELATED APPLICATION

This application claims priority from Japanese Patent Application No. 2016-229574 filed on Nov. 25, 2016, the contents of which are incorporated herein by reference in their entirety.

FIELD

Embodiments described herein relate generally to a sheet binding device, a sheet post-processing device, and an image forming apparatus.

BACKGROUND

It is required to realize a sheet binding device that binds an edge of a sheet bundle with an adhesive tape by use of a simplified mechanism.

DETAILED DESCRIPTION

Figure 1:
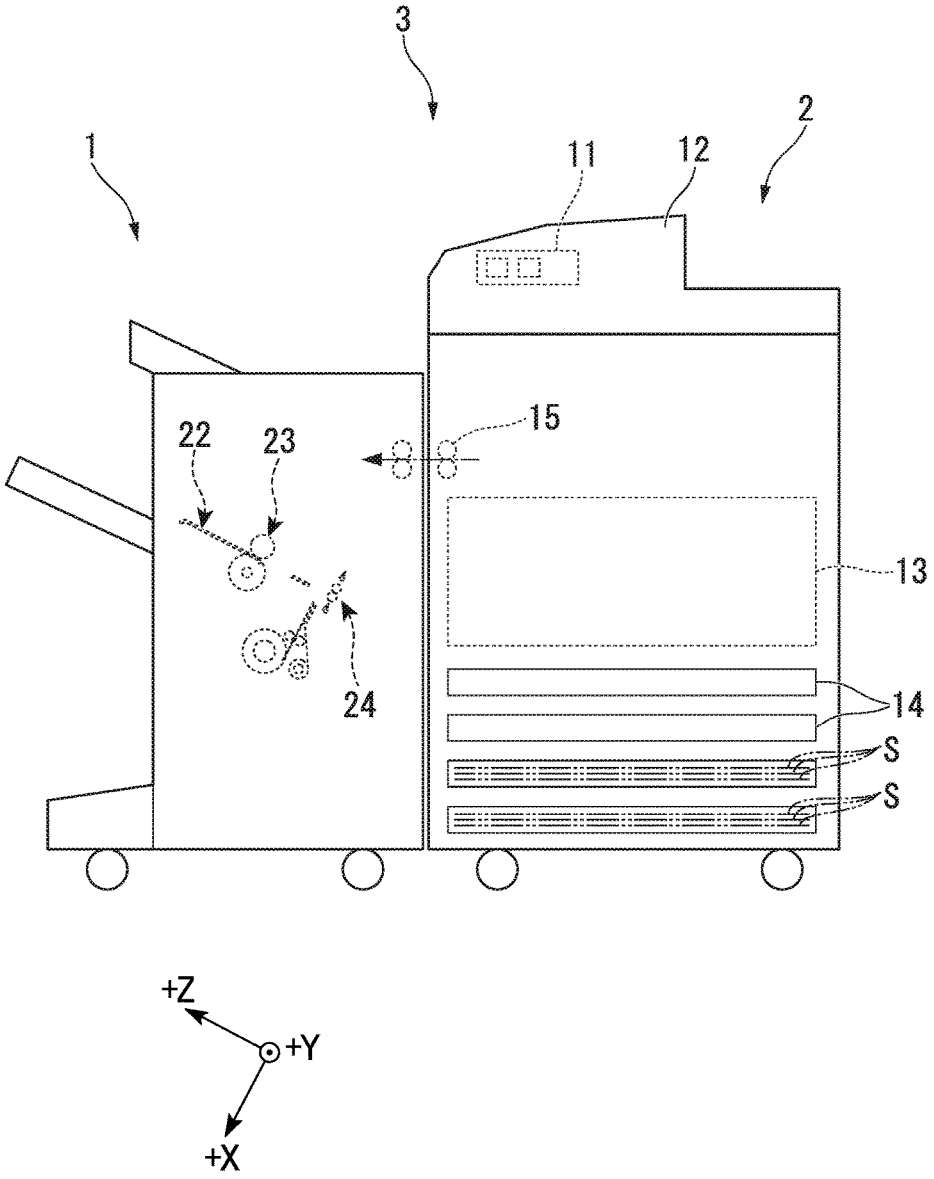
FIG. 1 is a front view showing an image forming apparatus including a sheet binding device of a first embodiment.

According to one embodiment, a sheet binding device includes a tape support base, a slide base, a tape holder, a first displacement mechanism, and a second displacement mechanism. The tape support base supports a tape. The slide base is movable in a first direction. The tape holder is supported on the slide base and is movable in a second direction crossing the first direction. The first displacement mechanism displaces the tape holder in a second direction from a first position that is a position away from the tape to a second position at which the tape holder is capable of coming into contact with the tape when the tape holder and the slide base move in the first direction toward the tape support base and receives the tape. The second displacement mechanism displaces the tape holder in the second direction from the second position to the first position when the tape holder and the slide base move in the first direction in which the tape holder becomes far from the tape support base.

Hereinafter, a sheet binding device, a sheet post-processing device, and an image forming apparatus according to an embodiment will be described with reference to the drawings. In the following description, configurations having the same or similar functions are denoted with the same reference numerals. Repeated description of the configurations may be omitted. In this disclosure, various sheet-shaped media including paper and the like are referred to as "sheets".

First Embodiment

A first embodiment will be described with reference to FIGS. 1 to 23.

FIG. 1 is a front view showing an image forming apparatus 3 including a sheet binding device (also referred to as a sheet processing device) 1 of this embodiment. The sheet binding device 1 of this embodiment is a binding device that binds an edge 5*a* of a sheet bundle 5 by use of tape T (see FIG. 4). For example, the sheet binding device 1 is a sheet post-processing device that performs post-processing on a sheet S conveyed from an image former 2. For example, the sheet binding device 1 may be placed on, for example, a desktop or a floor surface and used alone.

As shown in FIG. 1, the image forming apparatus 3 includes the sheet binding device 1, and the image former 2.

The image former 2 includes a control panel 11, a scanner 12, a printer 13, a sheet feeder 14, and a sheet discharger 15.

The control panel 11 includes various keys or the like, and receives an operation of a user. Information input through an operation with respect to the control panel 11 can be sent as a portion of a command to the sheet binding device 1.

The scanner 12 reads image information of a copy target. The printer 13 forms an image on the sheet S on the basis of image information received from the scanner 12 or an external device. The sheet feeder 14 supplies the sheet S to the printer 13. The sheet discharger 15 conveys the sheet S discharged from the printer 13 to the sheet binding device 1.

Next, the sheet binding device 1 will be described.

Figure 2:
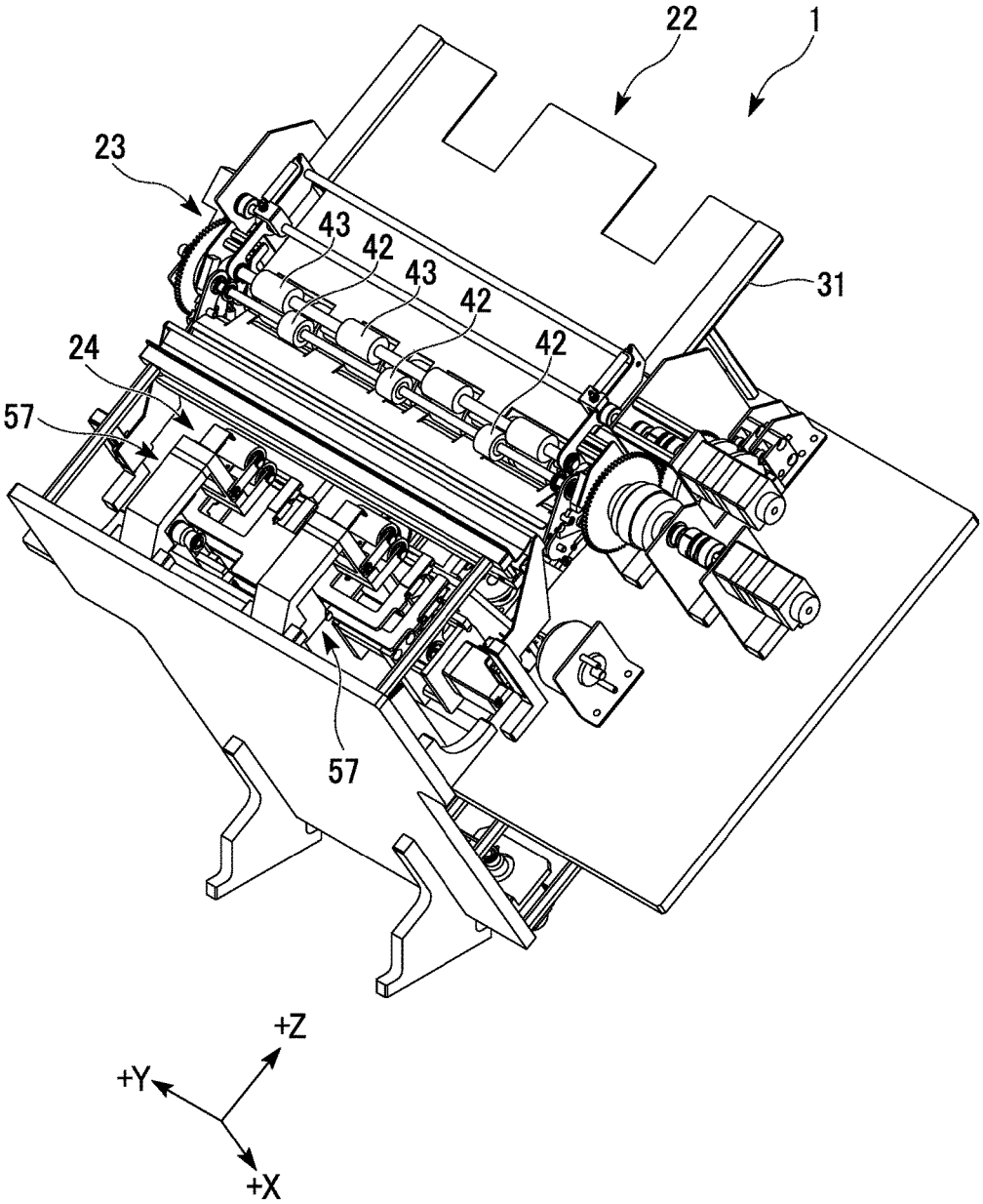
FIG. 2 is a perspective view showing a sheet binding device of the first embodiment.
Figure 3:
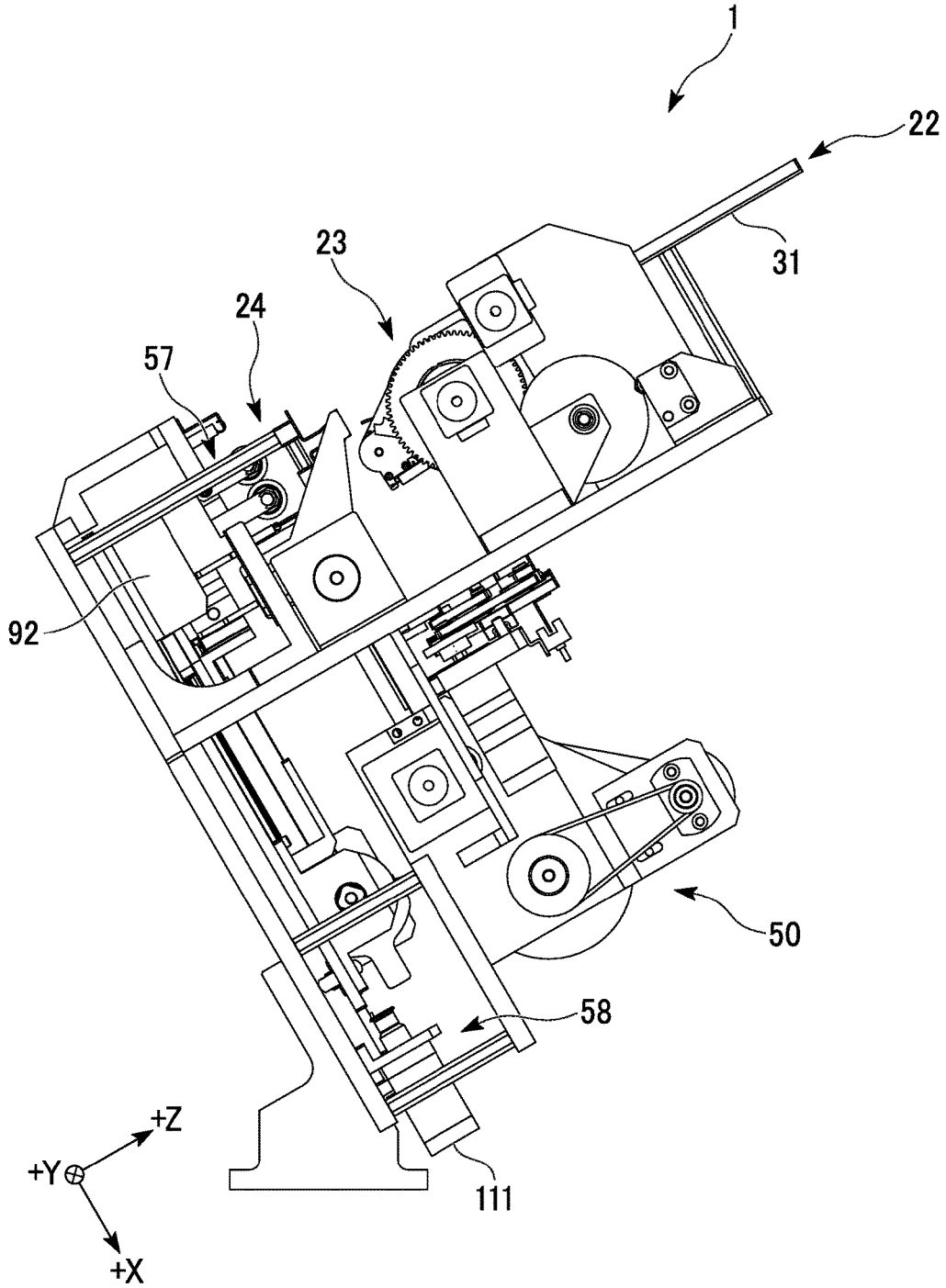
FIG. 3 is a front view showing an internal configuration of the sheet binding device of the first embodiment.

FIG. 2 is a perspective view showing the sheet binding device 1. FIG. 3 is a front view showing an internal configuration of the sheet binding device 1.

As shown in FIGS. 2 and 3, the sheet binding device 1 includes a bundle creator 22, a sheet separator 23, a sheet processor 24, and an interface (information acquisition unit) (not shown in the figure).

The interface acquires information of a plurality of sheets, a tape, and a method of binding a sheet bundle by use of the tape by receiving the information as a portion of a command from the image former (external device).

Figure 4:
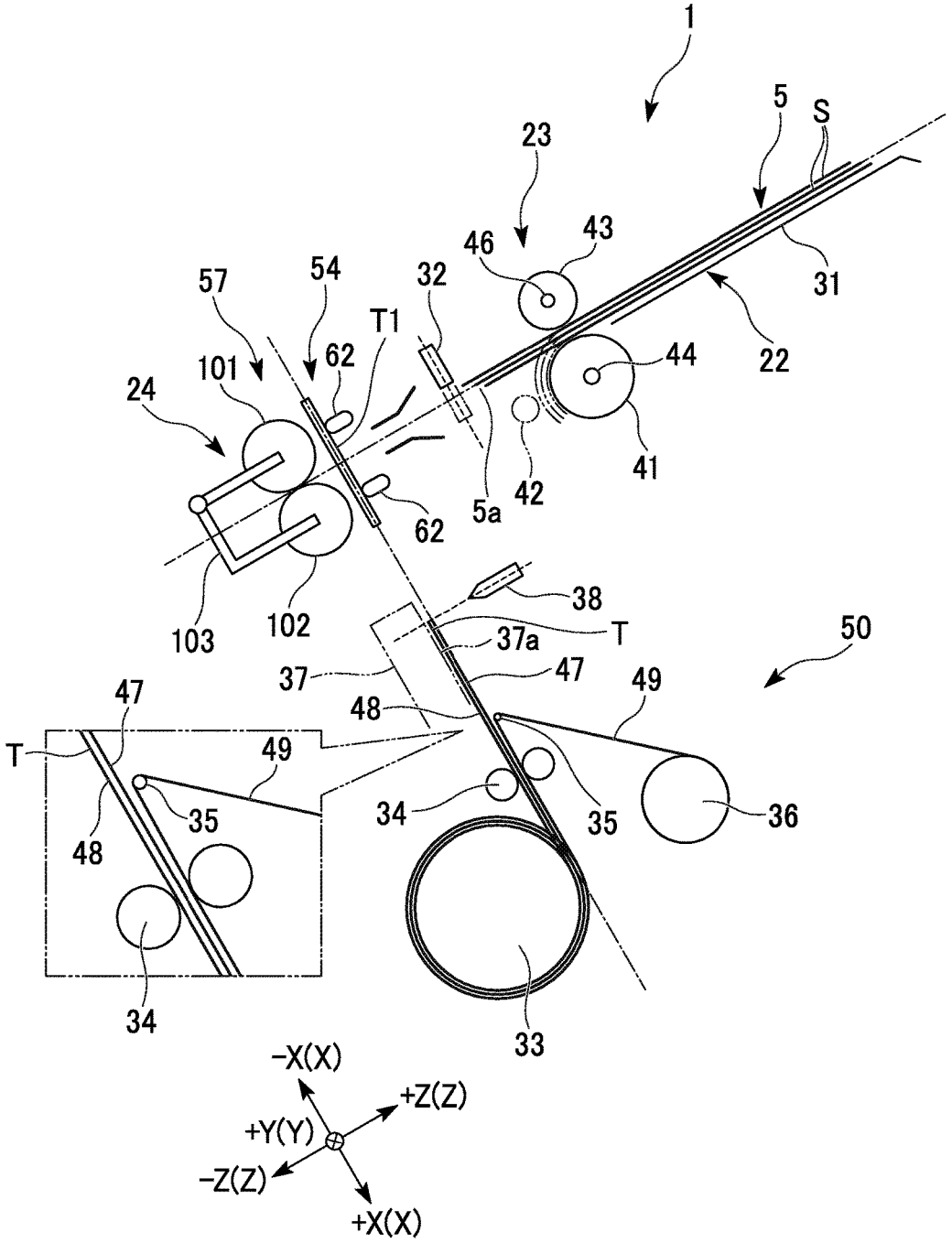
FIG. 4 is a schematic configuration diagram showing an internal configuration of the sheet binding device of the first embodiment.

FIG. 4 is a schematic configuration diagram showing an internal configuration of the sheet binding device 1.

As shown in FIG. 4, the bundle creator 22 creates a sheet bundle 5 including a plurality of sheets S by stacking a plurality of sheets S. The bundle creator 22 includes a main guide 31 and a stopper 32.

The main guide 31 guides the sheet S in a sheet conveyance direction. The sheets S are sequentially stacked on the main guide 31, thereby forming the sheet bundle 5.

The stopper 32 is provided at a downstream side end of the main guide 31 in the sheet conveyance direction. The stopper 32 is movable between a restriction position (indicated by a two-dot chain line in FIG. 4) and a release position (indicated by a solid line in FIG. 4) by a moving mechanism, which is not shown in the figure.

When the stopper 32 is at the restriction position, an end of the sheet S comes into contact with the stopper 32, thereby a movement of the sheet S in the sheet conveyance direction being restricted. As the movement of the sheet S is restricted, the sheet bundle 5 including a plurality of sheets S is formed on the main guide 31.

When the stopper 32 is at the release position, the sheet bundle 5 does not come into contact with the stopper 32 and is movable in the sheet conveyance direction.

The sheet separator 23 (sheet separation device) causes the plurality of sheets S to be sequentially displaced in the sheet conveyance direction little by little, thereby forming a state in which the plurality of sheets S forming the sheet bundle 5 are displaced from one another at the edge 5*a* of the sheet bundle 5. For example, the sheet separator 23 forms a state in which the plurality of sheets S are displaced in a stepwise manner at the edge 5*a* of the sheet bundle 5.

FIG. 5 is a side view showing a state in which the plurality of sheets S are displaced at the edge 5*a* of the sheet bundle 5.

Figure 5A:
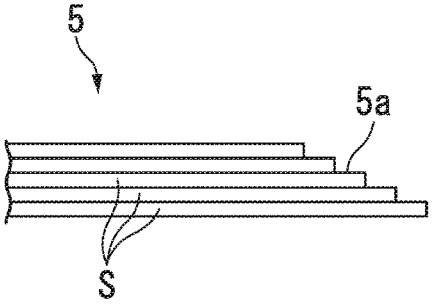
FIG. 5A is a side view showing a state in which a plurality of sheets are displaced at an edge of a sheet bundle in the first embodiment.
Figure 5B:
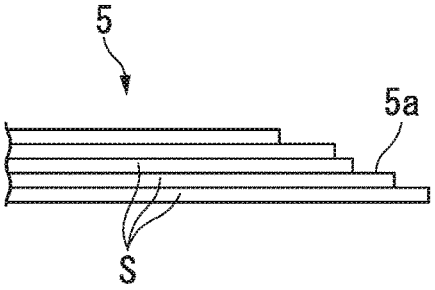
FIG. 5B is a side view showing a state in which a plurality of sheets are displaced at an edge of a sheet bundle in the first embodiment.

As shown in FIG. 5, "a state in which the plurality of sheets S forming the sheet bundle 5 are displaced from one another at the edge 5*a*" described in this disclosure means a state in which the plurality of sheets S are displaced from one another and overlap. In other words, the state means a state in which the edges of the plurality of stacked sheets S are displaced from one another, and the edges of the sheets S forming the sheet bundle 5 form steps. In other words, the state means that some of the plurality of sheets S overlap in a layer shape. Further, "a state in which the plurality of sheets S forming the sheet bundle 5 are displaced in a stepwise manner at the edge 5*a*" described in this disclosure means, for example, a state in which the amount of projection in the sheet conveyance direction of each sheet S gradually increases (or gradually decreases) in a stacking order of the plurality of sheets S. The present invention is not limited to the state in which a plurality of sheets S substantially uniformly are displaced from one another (see FIG. 5A), and the plurality of sheets S may be non-uniformly displaced from one another (see FIG. 5B).

As shown in FIG. 4, the sheet separator 23 includes a driving roller 41, a pressing roller 42, and a driven roller 43 (pressing roller).

The driving roller 41 is attached to the first shaft 44. The driving roller 41 is driven by a motor that is not shown in the figure via the first shaft 44. The driving roller 41 is rotatable about the first shaft 44. For example, at least an outer peripheral surface of the driving roller 41 is formed of ethylene propylene diene rubber (EPDM).

The driving roller 41 is rotated about the first shaft 44 and the pressing roller 42 is pivoted about the first shaft 44 with the sheet bundle 5 sandwiched between the pressing roller 42 and the driving roller 41 to perform a bending process of bending the sheet bundle 5. Accordingly, the plurality of sheets S can be displaced from one another at the edge 5*a*.

The meaning of "Rotation" includes a circular motion around an axis passing through a centroid of an operation subject itself. The meaning of "Pivoting" includes a circular motion around an axis that does not pass through the centroid of the operation subject itself.

Since the sheet bundle 5 is pressed by the pressing roller 42 and is pivoted while the edges 5*a* are aligned, displacement is caused among the sheets S according to a thickness of the sheet bundle 5. Therefore, if the pressing by the pressing roller 42 is released and the sheet bundle 5 is released, the sheet bundle 5 returns to an unbent state while displacement is caused among the plurality of sheets S, as indicated by a solid line.

The driven roller 43 is attached to a shaft 46 and is rotatable, for example, according to rotation of the driving roller 41. The driven roller 43 can approach the driving roller 41 and can be separated from the driving roller 41, and can press the sheet bundle 5 against the driving roller 41. For example, at least an outer peripheral surface of the driven roller 43 is formed of ethylene propylene diene rubber (EPDM).

Next, the sheet processor 24 will be described.

Figure 6:
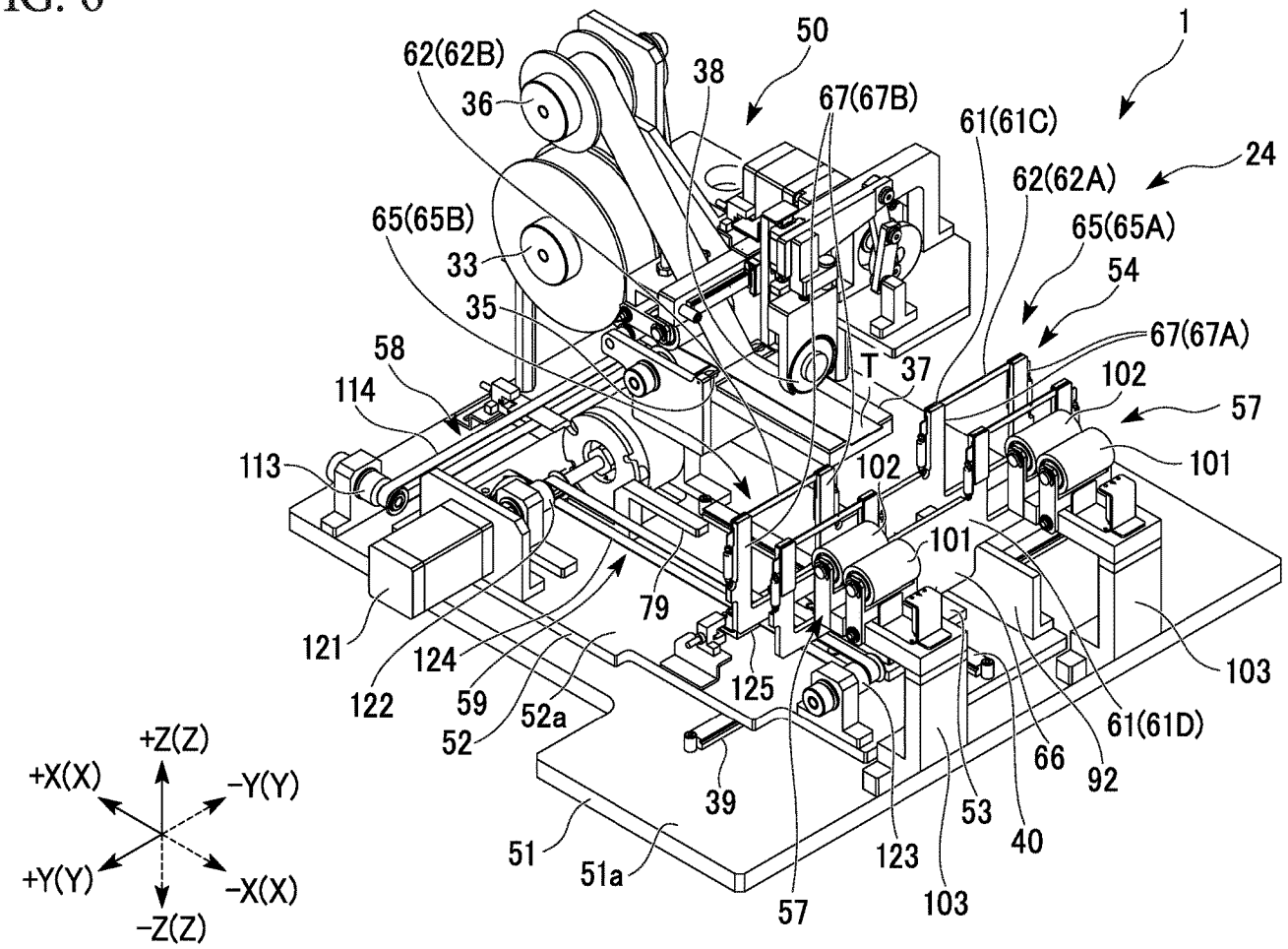
FIG. 6 is a perspective view showing an internal configuration of the sheet binding device of the first embodiment.

FIG. 6 is a perspective view showing an internal configuration of the sheet binding device 1.

Figure 9:
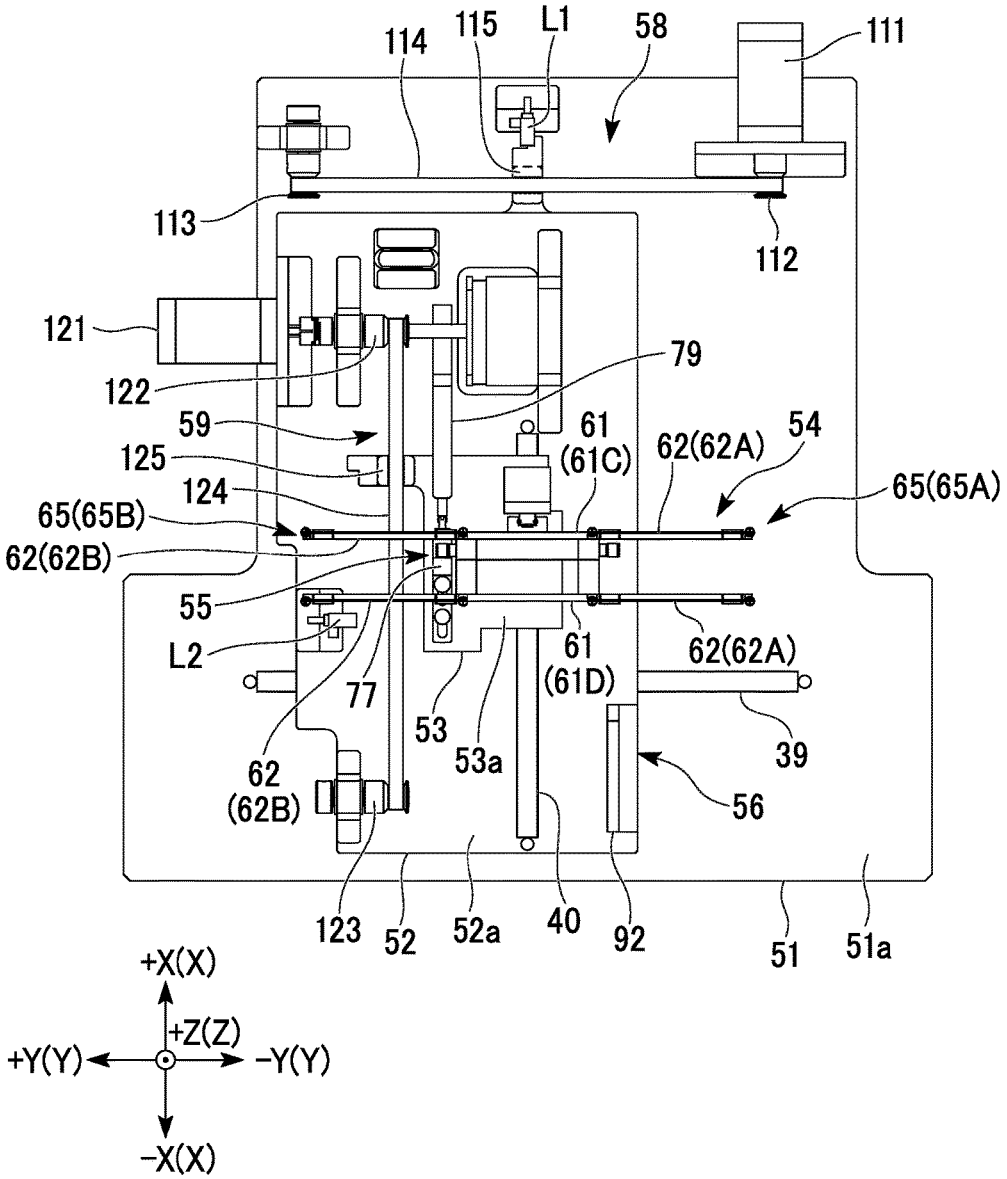
FIG. 9 is a plan view showing a portion of an internal configuration of the sheet binding device of the first embodiment.

As shown in FIG. 6, the sheet processor 24 includes a tape supply mechanism 50, a base 51, a stage 52, a stage moving mechanism 58, a slide base 53, a slide base moving mechanism 59, a tape holder 54, a first displacement mechanism 55 (see FIG. 9), a second displacement mechanism 56 (see FIG. 9), a tape attacher 57, and photo sensors L1 and L2 (see FIG. 9).

Hereinafter, description will be made using an XYZ coordinate system, as necessary.

An X direction is a direction in which the slide base 53 moves along a surface 51*a* (an upper surface) of the base 51, and is an example of a "first direction". One direction (a direction from the tape attacher 57 to the tape support base 37) in the X direction is referred to as a +X direction, and a direction opposite to the +X direction is referred to a −X direction. The +X direction may be referred to as a "forward direction", and the −X direction may be referred to as a "backward direction".

A Y direction is a direction that is within a plane along the surface 51*a* (the upper surface) of the base 51, is orthogonal to the X direction, and is an example of a "third direction". One direction in the Y direction may be referred to as a +Y direction, and a direction opposite to the +Y direction may be referred to as a −Y direction.

A Z direction is a direction orthogonal to the X direction and the Y direction and is an example of a "second direction". One direction in the Z direction is referred to as a +Z direction, and a direction opposite to the +Z direction is referred to as a −Z direction. The +Z direction is, for example, a direction along a vertically upward direction. The +Z direction may be referred to as an "upward direction" or a "height direction", and the −Z direction may be referred to as a "downward direction".

The +Z direction may not match the vertically upward direction, and can be a direction including a vertically upward component. In the example shown in FIGS. 2 and 3, the +Z direction is a direction that is not orthogonal to the vertical direction, and includes a vertically upward component.

A plane defined by the X direction and the Y direction is referred to as an XY plane. A plane defined by the X direction and the Z direction is referred to as an XZ plane. A plane defined by the Y direction and the Z direction is referred to as a YZ plane.

Figure 7:
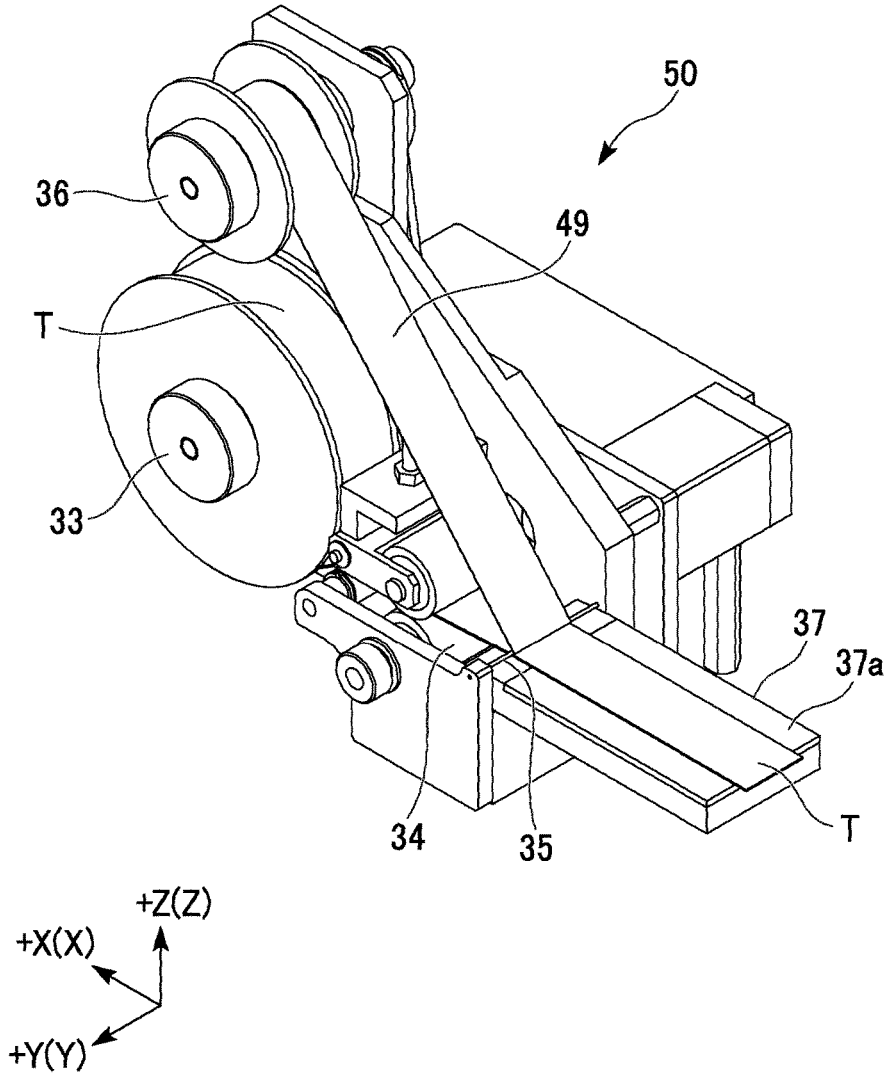
FIG. 7 is a perspective view showing a tape supply mechanism of the sheet binding device of the first embodiment.

FIG. 7 is a perspective view showing the tape supply mechanism 50 of the sheet binding device 1.

As shown in FIG. 7, the tape supply mechanism 50 includes an unwinder 33, a tape conveyance roller 34 (tape feeder), a separation member 35, a winder 36, the tape support base 37, and a cutter 38 (see FIG. 6).

The unwinder 33 holds, for example, a raw fabric roll on which a band-shaped tape T (hereinafter simply referred to as a "tape T") has been wound. The unwinder 33 supplies the tape T in a longitudinal direction of the tape T. The unwinder 33 is an example of a "tape supplier".

As shown in FIG. 4, the tape T includes an adhesive layer 47, a protective film 48, and a peelable film 49. The protective film 48 covers the adhesive layer 47. The protective film 48 is formed integrally with the adhesive layer 47 when the tape T is used. The peelable film 49 covers the adhesive layer 47 from the side opposite to the protective film 48. The peelable film 49 is peeled from the adhesive layer 47 before the tape T is used. The peelable film 49 is wound by the winder 36 via the separation member 35.

As shown in FIG. 7, the tape conveyance roller 34 conveys the tape T supplied from the unwinder 33 toward the tape support base 37 in a longitudinal direction of the tape T. The tape support base 37 guides the tape T from which the peelable film 49 has been separated, onto an upper surface 37*a*. The upper surface 37*a* is, for example, a surface along an XY plane.

As shown in FIG. 6, the cutter 38 is moved in the Y direction by a drive mechanism (no reference numeral) to cut the tape T on the tape support base 37 to a predetermined length. For example, the cutter 38 is a rotor cutter. The cutter 38 is movable in a direction in which it approaches the tape T and a direction in which it becomes far from the tape T by a moving mechanism (no reference numeral).

Figure 8:
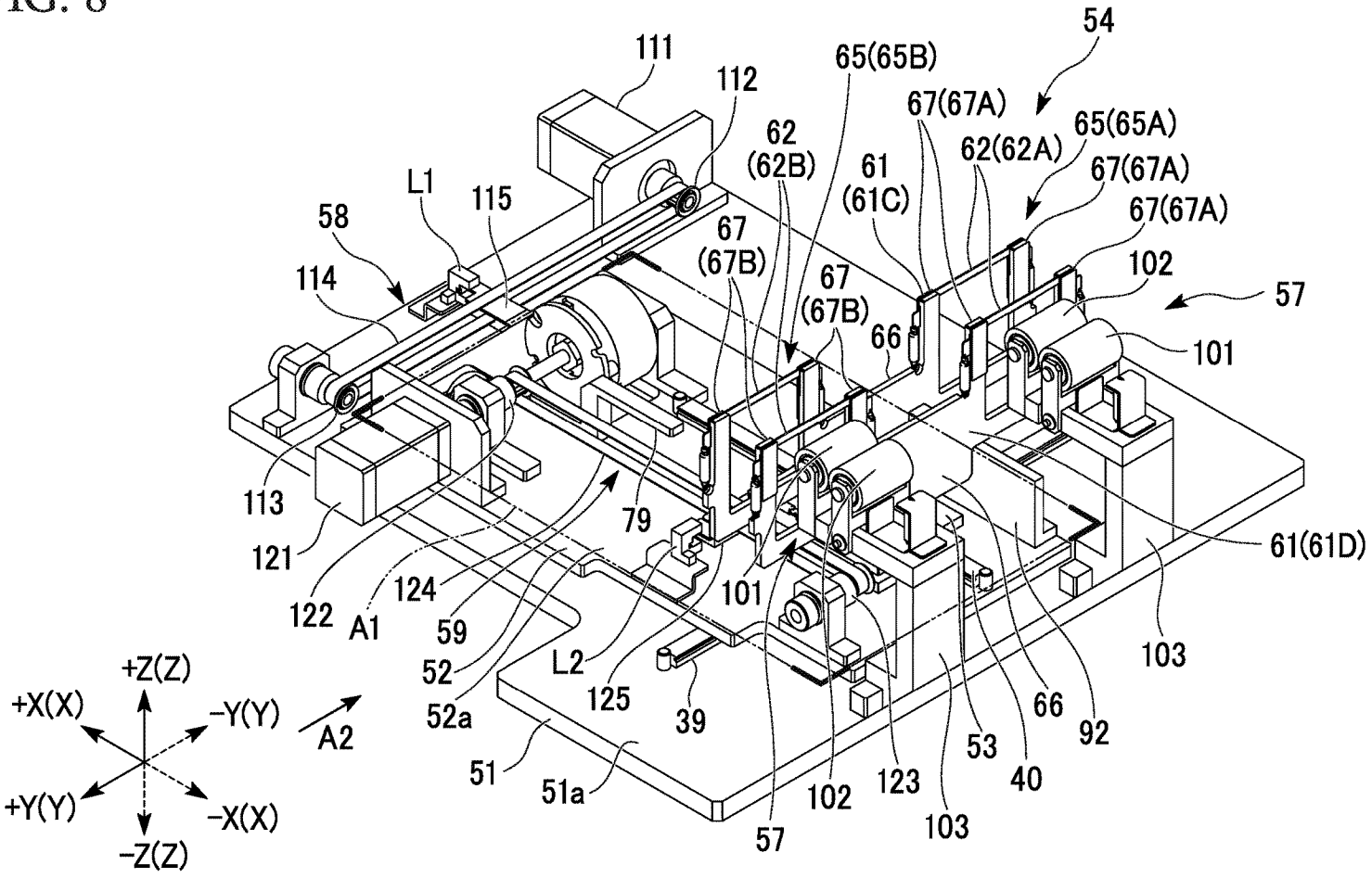
FIG. 8 is a perspective view showing a portion of the sheet binding device of the first embodiment.

FIG. 8 is a perspective view showing an internal configuration of the sheet binding device 1. FIG. 9 is a plan view showing an internal configuration of the sheet binding device 1. In FIGS. 8 and 9, the tape supply mechanism 50 is not shown in the figure.

As shown in FIG. 8 (FIG. 9), the base 51 is roughly a rectangular plate. On the upper surface 51*a* of the base 51, a slide rail 39 is provided in the Y direction.

The stage 52 is a substantially rectangular plate body. The stage 52 is arranged on the upper surface 51*a* of the base 51. The stage 52 is movable in the Y direction along the slide rail 39 with respect to the base 51. On a surface 52*a* (upper surface 52*a*) of the stage 52, a slide rail 40 is provided along the X direction.

Figure 10:
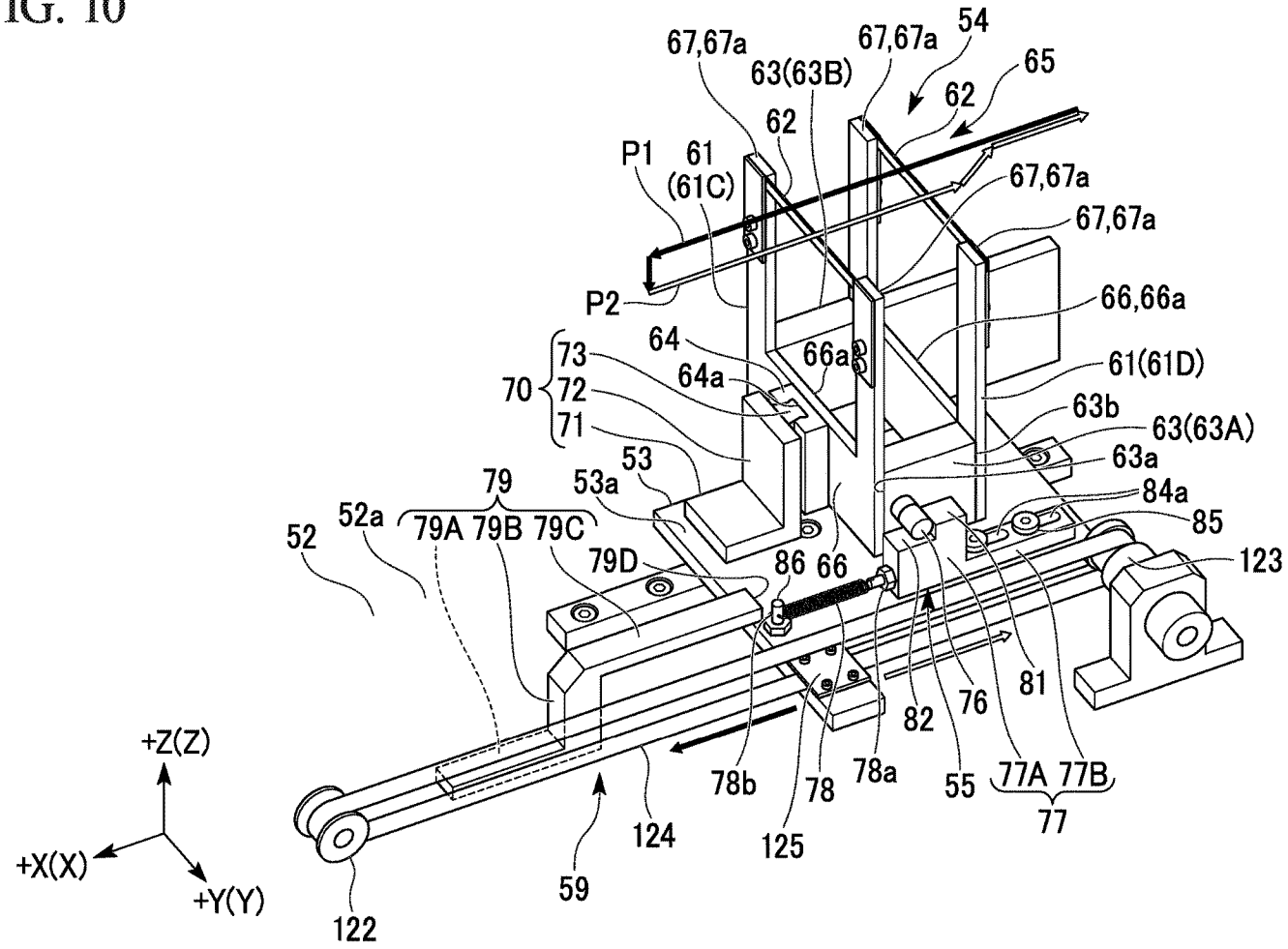
FIG. 10 is a perspective view showing a portion of the sheet binding device of the first embodiment.

The slide base 53 is a substantially rectangular plate body. The slide base 53 is arranged on the upper surface 52*a* of the stage 52. The slide base 53 is movable (retractable) in the X direction along the slide rail 40 relative to the stage 52. FIG. 10 is a perspective view showing a portion of the sheet binding device 1.

FIG. 10 is a diagram schematically showing a portion A1 of the sheet binding device 1 in FIG. 8. In FIG. 10, only some of members supported on the slide base 53 are shown. In FIG. 10, the tape supply mechanism 50 is not shown in the figure. FIG. 10 is a perspective view showing some of members supported on the slide base 53 when viewed from an A2 direction in FIG. 8.

As shown in FIG. 10, a guide member 70 that guides the tape holder 54 is formed on the upper surface 53*a* of the slide base 53.

The guide member 70 includes a base portion 71, a main plate 72, and a projected guide 73. The base portion 71 has a rectangular plate shape, and is fixed to the upper surface 53*a* of the slide base 53. The main plate 72 has, for example, a rectangular plate shape along a YZ plane and extends in an upward direction from a rear end of the base portion 71. The projected guide 73 (guide rail) is a projected portion formed in the Z direction on a rear surface of the main plate 72.

As shown in FIG. 10, the tape holder 54 includes a support member 61, a holding bar 62, a side wall 63, and a guide body 64. The tape holder 54 is arranged on the upper surface 53*a* of the slide base 53 and supported on the slide base 53. Therefore, the tape holder 54 is movable in the X direction together with the slide base 53.

The pair of support members 61 and 61 are provided to face each other at an interval in the X direction. Among the pair of support members 61 and 61, the support member 61 on the front side may be referred to as a first support member 61C, and the support member 61 on the rear side may be referred to as a second support member 61D.

The support member 61 includes a base body 66 and a strut 67.

As shown in FIG. 10, the base body 66 has, for example, a plate shape along the YZ plane.

The pair of struts 67 and 67 extend in an upward direction (the +Z direction) at an interval in the Y direction from an upper edge 66*a* of the base body 66. It is preferable that extension lengths of the struts 67 and 67 be the same as each other.

Figure 11:
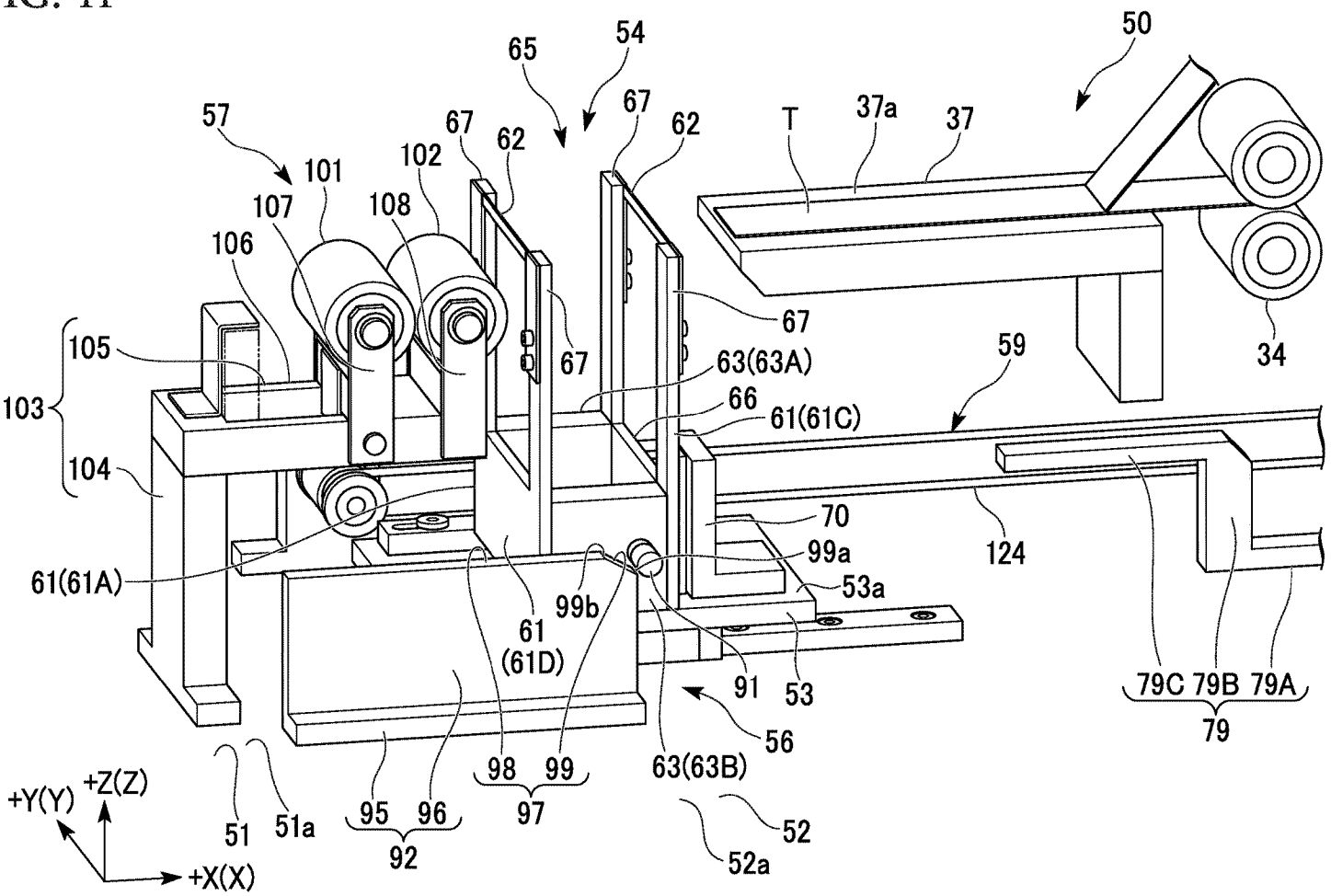
FIG. 11 is a perspective view showing a portion of the sheet binding device of the first embodiment.

The support member 61 includes two pairs of struts 67 and 67 as shown in FIG. 8, but an example in which only a pair of struts 67 and 67 are formed in the support member 61 is shown in FIGS. 10 and 11 to facilitate understanding.

As shown in FIG. 10, the holding bar 62 has, for example, an elongated plate shape, a round bar shape, or the like, and bridges between end portions 67*a* and 67*a* of the struts 67 and 67. The holding bar 62 extends, for example, in the Y direction.

The holding bars 62 and 62 provided on the pair of support members 61 and 61 are, for example, at the same height position.

The struts 67 and 67 of the pair of support members 61 and 61 and the holding bars 62 and 62 provided between the struts 67 and 67 are referred to as a tape receiver 65.

The side wall 63 has, for example, a thick plate shape along the XZ plane. The side wall 63 is provided between the base bodies 66 and 66 of the pair of support members 61 and 61. The front end 63*a* of the side wall 63 is fixed to the rear surface of the base body 66 of the first support member 61C. The rear end 63*b* of the side wall 63 is fixed to the front surface of the base body 66 of the second support member 61D. The side walls 63 and 63 are fixed to the base bodies 66 and 66 to connect the pair of support members 61 and 61.

The pair of side walls 63 and 63 are provided with an interval therebetween in the Y direction. The side walls 63 and 63 are fixed, for example, to one end and the other end in the Y direction of the base body 66, respectively.

The guide body (slider) 64 has a block shape and is provided on an outer surface of one of the support members 61, for example, on a front surface of the base body 66 of the first support member 61C. In the front surface of the guide body 64, a guide groove 64*a* is formed in a vertical direction (Z direction). The projected guide 73 of the guide member 70 provided on the upper surface 53*a* of the slide base 53 is inserted into the guide groove 64*a*. A linear guide can be adopted as the projected guide 73 (guide rail) and the guide body 64 (slider).

As shown in FIG. 8, the support member 61 actually includes two pairs of struts 67 and 67.

Hereinafter, the support member 61 will be described again.

The support member 61 has a plate shape in which the base body 66, a first pair of struts 67A and 67A, and a second pair of struts 67B and 67B are included. The first pair of struts 67A and 67A and the second pair of struts 67B and 67B are formed with an interval therebetween in the Y direction.

The holding bars 62 provided in the first pair of struts 67A and 67A are referred to as first holding bars 62A, and the holding bars 62 provided in the second pair of struts 67B and 67B are referred to as second holding bars 62B.

The first pair of struts 67A and 67A and the first holding bar 62A of the first support member 61C and the first pair of struts 67A and 67A and the first holding bar 62A of the second support member 61D are referred to as a first tape receiver 65A. The second pair of struts 67B and 67B and the second holding bar 62B of the first support member 61C and the second pair of struts 67B and 67B and the second holding bar 62B of the second support member 61D are referred to as a second tape receiver 65B.

As shown in FIG. 10, the tape holder 54 is vertically movable relative to the slide base 53 in a state in which the projected guide 73 is inserted into the guide groove 64*a*. Specifically, the tape holder 54 is vertically movable between a first position P1 (raised position) and a second position P2 (lowered position).

Figure 13:
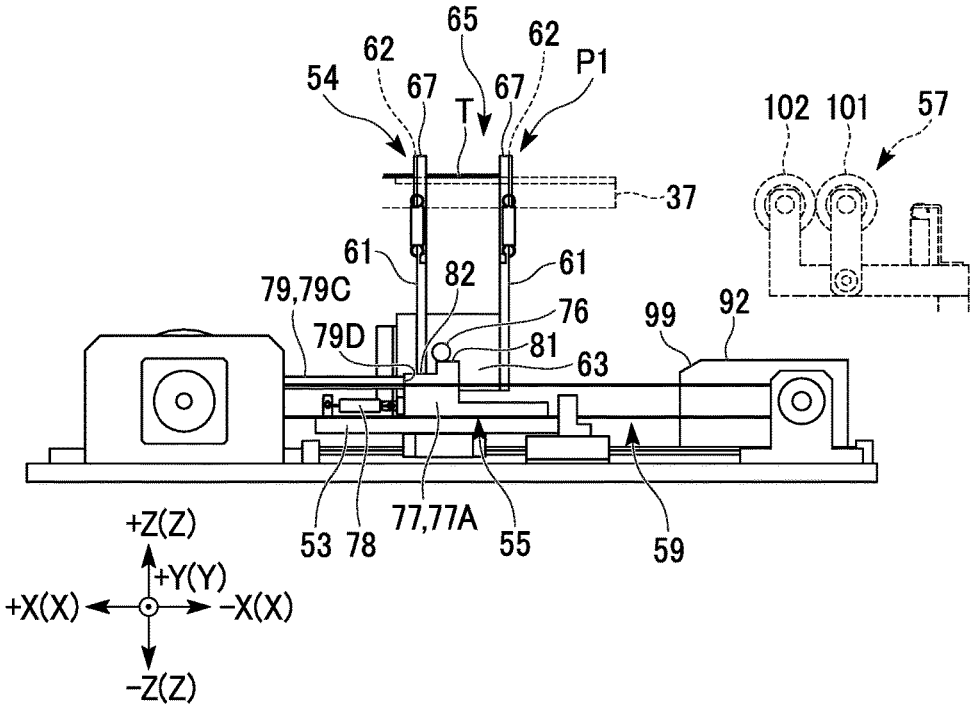
FIG. 13 is a front view showing an operation of the sheet binding device of the first embodiment.

As shown in FIG. 13, when the tape holder 54 is at the first position P1, the holding bars 62 and 62 arranged in upper ends of the struts 67 and 67 are at higher positions than the tape T on the tape support base 37 with respect to the height position (a position in the Z direction). In the tape holder 54 at this position, the holding bars 62 and 62 do not come into contact with the tape T.

Figure 14:
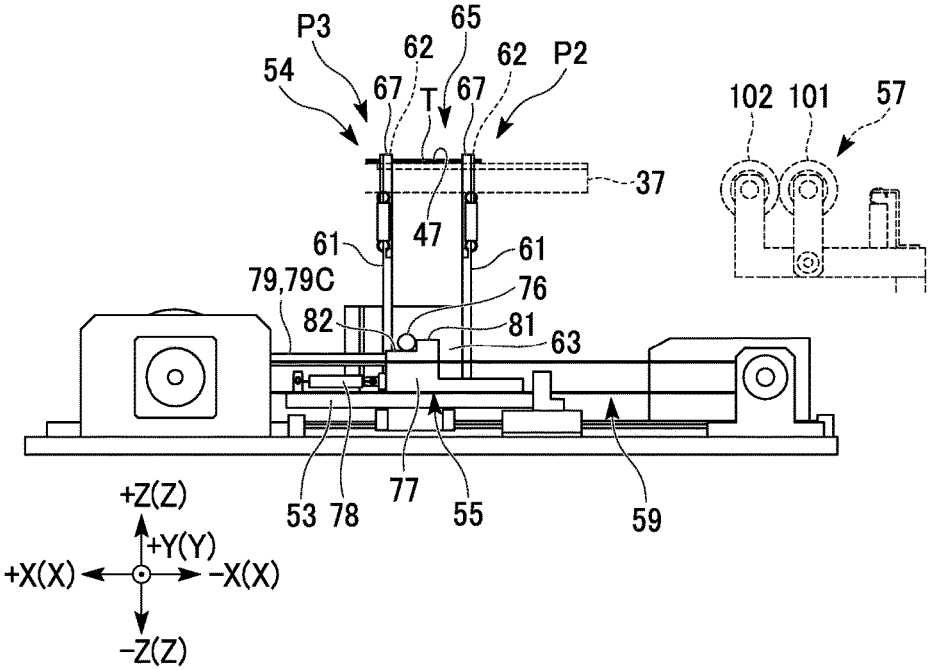
FIG. 14 is a front view showing an operation of the sheet binding device of the first embodiment.

As shown in FIG. 14, when the tape holder 54 is at the second position P2, the holding bars 62 and 62 arranged in upper ends of the struts 67 and 67 are at heights at which the holding bars 62 and 62 can come into contact with the tape T on the tape support base 37 at the height position (the position in the Z direction).

As shown in FIG. 10, the first displacement mechanism 55 is a mechanism that displaces the tape holder 54 from the first position P1 (raised position) to the second position P2 (lowered position) with respect to the height position (a position in the Z direction).

The first displacement mechanism 55 includes a first projection 76, a first displacement member 77, a force-applying member 78, and a stopper 79.

The first projection 76 is formed to project in the +Y direction on the outer surface of one side wall 63A (side wall 63 in the +Y direction) among the pair of side walls 63 and 63 of the tape holder 54. The first projection 76 has, for example, a pillar shape of which a center axis coincides with the Y direction.

The first displacement member 77 includes a block-shaped main body 77A, and a plate-shaped extension portion 77B that extends in a backward direction (in the −X direction) from a lower portion of a rear surface of the main body 77A. The first displacement member 77 is arranged on the upper surface 53*a* of the slide base 53 and is supported on the slide base 53.

A first stepped portion 81 and a second stepped portion 82 lower than the first stepped portion 81 are formed on the upper surface of the main body 77A. Each of the first stepped portion 81 and the second stepped portion 82 is a plane along the XY plane. The second stepped portion 82 is located in front (on the +X direction side) of the first stepped portion 81 when viewed from the +Z direction.

The first stepped portion 81 has a height such that the tape holder 54 is arranged at the first position P1 (raised position) when the first projection 76 is placed thus. The second stepped portion 82 has a height such that the tape holder 54 is arranged at the second position P2 (lowered position) when the first projection 76 is placed thus.

A plurality of elongated guide holes 84*a* and 84*a* extending in the X direction are formed in the extension portion 77B to penetrate the extension portion 77B. Fixtures 85 are inserted into the elongated guide holes 84*a*, and an end portion of the fixture 85 is fixed to the slide base 53. The first displacement member 77 is movable in a front-back direction (X direction) along the elongated guide holes 84*a* and 84*a* relative to the slide base 53 in a state in which movement in the Y direction is restricted by the fixtures 85.

The force-applying member 78 is, for example, a coil spring and applies a force to the first displacement member 77 forward (in the +X direction). One end 78*a* (rear end) of the force-applying member 78 is fixed to the front surface of the main body 77A of the first displacement member 77, and the other end 78*b* (front end) is fixed to the fixture 86 provided on the upper surface 53*a* of the slide base 53.

The stopper 79 includes a base portion 79A, a strut 79B, and an extension portion 79C. The base portion 79A is fixed to the upper surface 52*a* of the stage 52. The strut 79B has, for example, a prismatic shape and extends in the +Z direction from the rear end of the base portion 79A.

The extension portion 79C has, for example, an elongated plate shape along the XY plane, and extends in a backward direction (in the −X direction) from the upper end of the strut 79B. A height position and a position in the Y direction of the extension portion 79C are determined so that the end 79D can come into contact with the front surface of the main body 77A of the first displacement member 77.

The stopper 79 is provided at a position at which the tape holder 54 can move from the first position P1 (raised position) to the second position P2 (lowered position), at a position (tape reception position P3) at which the tape holder 54 receives the tape T on the tape support base 37.

FIG. 11 is a perspective view showing a portion of the sheet binding device 1 when viewed from a direction opposite to the direction in FIG. 10. In FIG. 11, a portion of the tape supply mechanism 50, and a tape attacher 57 are shown in addition to the members supported on the same slide base 53 as in FIG. 10.

As shown in FIG. 11, the second displacement mechanism 56 includes a second projection 91 and a second displacement member 92.

The second projection 91 is formed to project in the −Y direction on the outer surface of the other side wall 63B (side wall 63 in the −Y direction) among the pair of side walls 63 and 63 of the tape holder 54. The second projection 91 has, for example, a pillar shape of which a center axis coincides with the Y direction.

The second displacement member 92 includes a base portion 95 and a main plate 96. The base portion 95 is fixed to the upper surface 52*a* of the stage 52.

The main plate 96 is a schematically rectangular plate body. The main plate 96 has, for example, a plate shape along the XZ plane and extends upwardly from one side edge of the base portion 95.

An upper edge 97 of the main plate 96 includes a main portion 98 in the X direction, and an inclination 99 inclined with respect to the main portion 98.

The inclination 99 is located in front (+X direction side) of the main portion 98.

The inclination 99 is inclined so as to increase in height from a forward side (+X direction side) to a backward side (−X direction). That is, the inclination 99 is inclined so as to gradually increase in height from a front end 99*a* (second portion) to a rear end 99*b* (first portion). The rear end 99*b* is located at the same height position as a front end of the main portion 98.

The front end 99*a* (second portion) of the inclination 99 has, for example, a height such that the tape holder 54 is arranged at the second position P2 (lowered position) when the second projection 91 is placed. The rear end 99*b* (first portion) of the inclination 99 has, for example, a height such that the tape holder 54 is arranged at the first position P1 (raised position) when the first projection 76 is placed.

The second portion of the inclination 99 in which the tape holder 54 is placed may not be the front end 99*a* and may be, for example, a portion between the front end 99*a* and the rear end 99*b* (a portion at a position lower than the rear end 99*b*).

The second displacement member 92 is provided at a position at which the tape holder 54 can be arranged between the second position P2 and the first position P1 until the tape holder 54 reaches a tape processing position P4 that is a position to which the tape holder 54 has retracted from the tape reception position P3 (see FIG. 14, for example).

Figure 18:
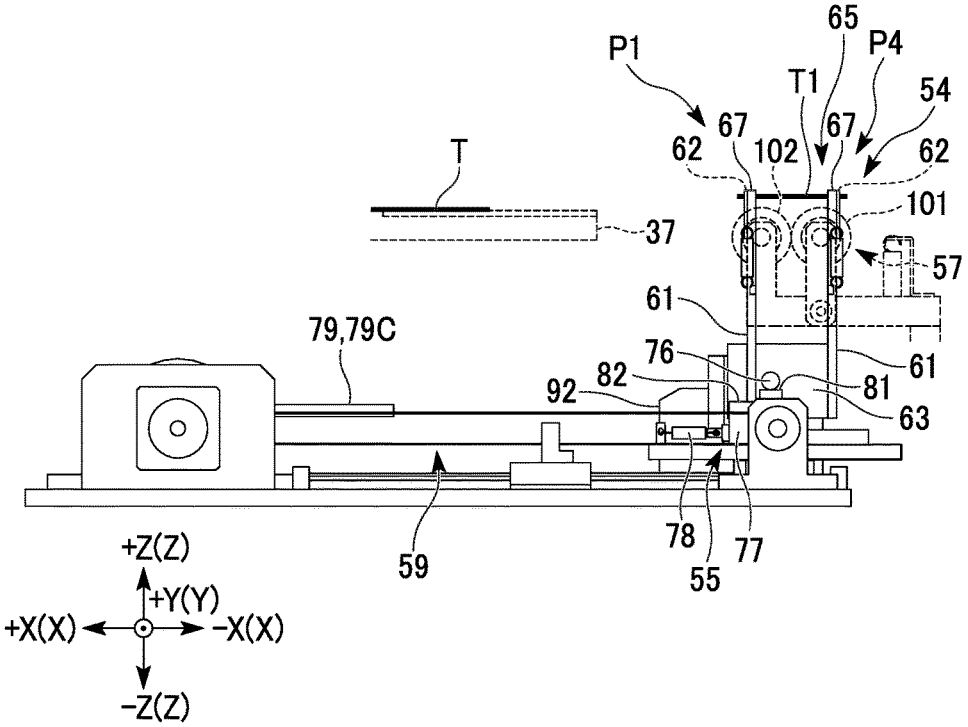
FIG. 18 is a front view showing an operation of the sheet binding device of the first embodiment.

The tape processing position P4 may be any position until the tape holder 54 retracting from the tape reception position P3 reaches the tape attacher 57 or may be a position at which the tape section T1 is arranged on the tape attacher 57 (position shown in FIG. 18).

As shown in FIG. 11, the tape attacher 57 (tape processor) includes a first roller 101, a second roller 102, and a support body 103 that supports the first roller 101 and the second roller 102. By a force-applying member, a force is applied to the first roller 101 to be directed to the second roller 102.

As shown in FIG. 11, the support body 103 includes a strut 104 and a roller support portion 105. The strut 104 is formed to extend from the upper surface 51*a* (see FIG. 8) of the base 51 to an upward direction (+Z direction). The roller support portion 105 includes a support base portion 106 extending in the +X direction from an end portion of the strut 104, and roller holders 107 and 108 that rotatably hold the first roller 101 and the second roller 102 provided in the support base portion 106.

As shown in FIG. 8, a pair of tape attachers 57 are provided with an interval therebetween in the Y direction.

As shown in FIG. 8, the stage moving mechanism 58 can move the stage 52 to an arbitrary position in the Y direction along the slide rail 39. The stage moving mechanism 58 is an example of a "second moving mechanism".

The stage moving mechanism 58 includes a driving source 111, a third timing pulley 112, a fourth timing pulley 113, and a second timing belt 114.

The driving source 111 is, for example, a motor, and is provided on the upper surface 51*a* of the base 51. The third timing pulley 112 is provided on a rotation shaft of the driving source 111. The fourth timing pulley 113 is provided at a position away from the third timing pulley 112 in the Y direction, on the upper surface 51*a* of the base 51.

The second timing belt 114 bridges between the third timing pulley 112 and the fourth timing pulleys 113. A portion of the second timing belt 114 is connected to the stage 52 by a connection body 115. Therefore, the second timing belt 114 is driven by driving of the driving source 111, thereby being able to move the stage 52 and the slide base 53 to an arbitrary position in the Y direction along the slide rail 39.

The slide base moving mechanism 59 can move the slide base 53 to an arbitrary position in the X direction along the slide rail 40. The slide base moving mechanism 59 is an example of a "first moving mechanism".

The slide base moving mechanism 59 includes a driving source 121, a first timing pulley 122, a second timing pulley 123, and a first timing belt 124.

The driving source 121 is, for example, a motor, and is provided on the upper surface 52*a* of the stage 52.

The first timing pulley 122 is provided on a rotation shaft of the driving source 121. The second timing pulley 123 is provided at a position in the X direction away from the first timing pulley 122, on the upper surface 52*a* of the stage 52.

The first timing belt 124 is bridged between the first timing pulley 122 and the second timing pulleys 123. A portion of the first timing belt 124 is connected to the slide base 53 by a connection body 125. Therefore, the first timing belt 124 is driven by driving of the driving source 121, thereby being able to move the slide base 53 to an arbitrary position in the X direction along the slide rail 40.

As shown in FIG. 9, a photo sensor L1 can receive light from a light source, which is not shown in the figure. When the stage 52 reaches a predetermined position in the Y direction and a sensed plate extending from the connection body 115 blocks the light from the light source, the photo sensor L1 can detect this.

A photo sensor L2 can receive light from a light source, which is not shown in the figure. When the slide base 53 reaches a predetermined position in the X direction and a sensed plate extending from the connection body 125 blocks the light from the light source, the photo sensor L2 can detect this. For example, when the tape holder 54 is arranged at a position at which the tape holder 54 can move in the Y direction (for example, the position in FIG. 17) in a course in which the tape holder 54 moves in the X direction, the photo sensor L2 can detect this.

Next, an example of an operation of the sheet binding device 1 will be described.

(Tape Reception Process)

As shown in FIG. 4, the tape conveyance roller 34 conveys the tape T supplied from the unwinder 33, in the −X direction. In the tape T, the peelable film 49 is separated by the separation member 35 and the adhesive layer 47 is arranged on the upper surface 37*a* of the tape support base 37 in a state in which the adhesive layer 47 is exposed on the upper surface side.

FIGS. 12 to 23 are front views showing an example of an operation of the sheet binding device 1. In FIGS. 12 to 18, a portion of the tape supply mechanism 50, the tape holder 54, the slide base 53, the slide base moving mechanism 59, the first displacement mechanism 55, and the second displacement mechanism 56 are shown.

Figure 12:
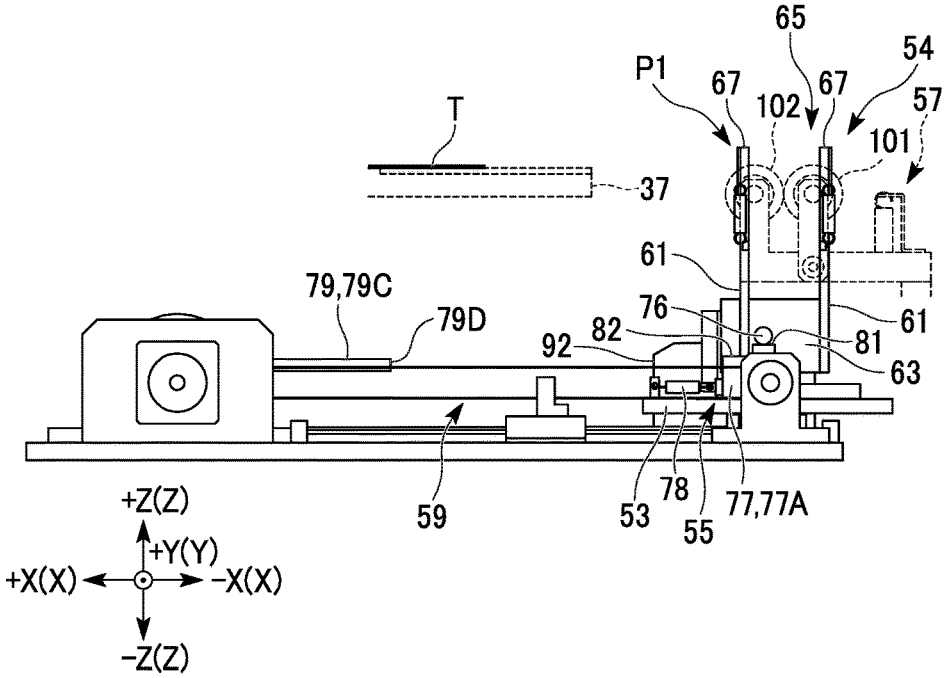
FIG. 12 is a front view showing an operation of the sheet binding device of the first embodiment.

In an initial state shown in FIG. 12 (for example, a state in which attachment of the tape T to the sheet bundle 5 has ended), the first projection 76 of the first displacement mechanism 55 is placed on the first stepped portion 81 of the first displacement member 77. The second projection 91 of the second displacement mechanism 56 is placed on the main portion 98 of the main plate 96 of the second displacement member 92 (see FIG. 11). Therefore, the tape holder 54 is at the first position P1 (raised position) with respect to the height position (a position in the Z direction).

As shown in FIG. 13, the slide base 53 is moved forward in the +X direction by use of the slide base moving mechanism 59, thereby moving the tape holder 54 and the first displacement member 77 forward in the +X direction. In this case, as shown in FIG. 6, the position in the Y direction of the tape holder 54 is adjusted to a position at which the first tape receiver 65A can receive the tape T by use of the stage moving mechanism 58, as necessary. In this case, it is preferable for the first holding bar 62A of the tape receiver 65A and a center position in the Y direction of the tape support base 37 to coincide with each other.

As shown in FIG. 13, the tape holder 54 is caused to move forward, thereby locating the tape receiver 65 (specifically, the first holding bars 62 and 62 (62A and 62A) of the tape receiver 65A shown in FIG. 8) on the tape support base 37 while maintaining the first position P1 (raised position).

Due to the forward movement of the slide base 53, a front surface of the main body 77A of the first displacement member 77 comes into contact with the end 79D of the extension portion 79C of the stopper 79.

As shown in FIG. 14, if the slide base 53 is caused to move further forward, forward movement of the first displacement member 77 is obstructed by the stopper 79, whereas the tape holder 54 continues to forward move. Therefore, the first projection 76 moves forward on the first stepped portion 81, and falls onto the second stepped portion 82 due to a weight of the tape holder 54 via a front end of the first stepped portion 81. In this case, a direction in which the tape holder 54 is displaced from the first stepped portion 81 to the second stepped portion 82 is, for example, the −Z direction.

Accordingly, the tape holder 54 is moves downward, and a height position of the holding bars 62 and 62 arranged on upper ends of the struts 67 and 67 transitions from the first position P1 (raised position) shown in FIG. 13 to the second position P2 (lowered position) shown in FIG. 14.

The holding bars 62 and 62 come into contact with the adhesive layer 47 of the tape T to hold the tape T.

A position of the tape holder 54 at which the holding bars 62 and 62 come into contact with the tape T is referred to as the tape reception position P3. The tape reception position P3 is a position in the X direction of the tape holder 54 at which the holding bars 62 and 62 can receive the tape T.

Figure 15:
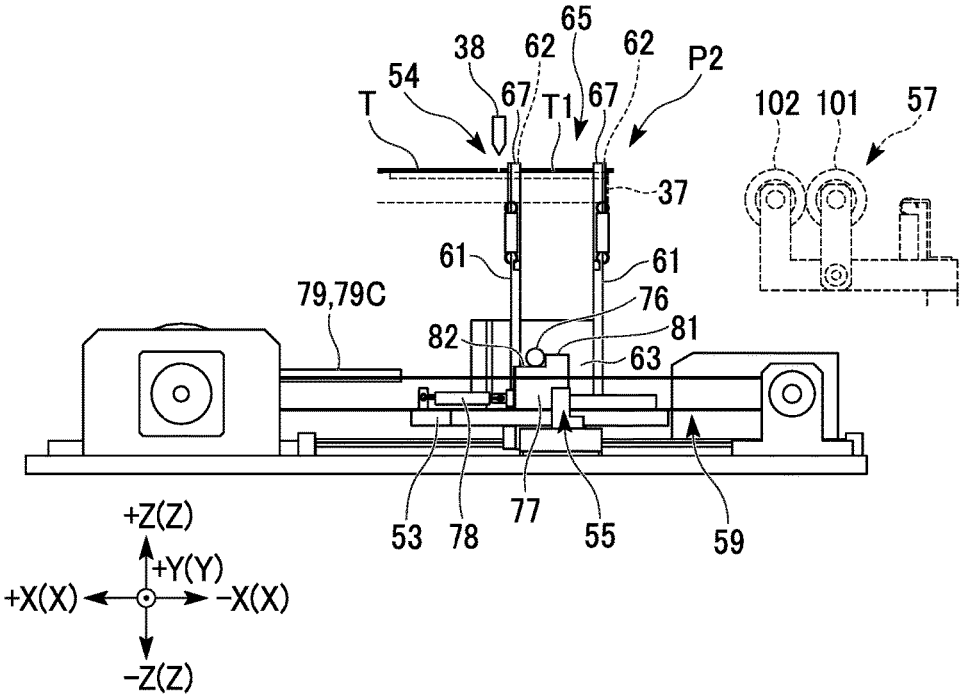
FIG. 15 is a front view showing an operation of the sheet binding device of the first embodiment.

Next, as shown in FIG. 15, the slide base 53 and the tape holder 54 are caused to retract in the −X direction by use of the slide base moving mechanism 59. In this case, the tape T is sent in the −X direction by the tape conveyance roller 34 (see FIG. 7) according to a movement distance of the tape holder 54.

The tape T on the tape support base 37 is cut to a predetermined length by the cutter 38 at a forward position relative to the holding bars 62 and 62, and the tape section T1 is obtained.

Figure 16:
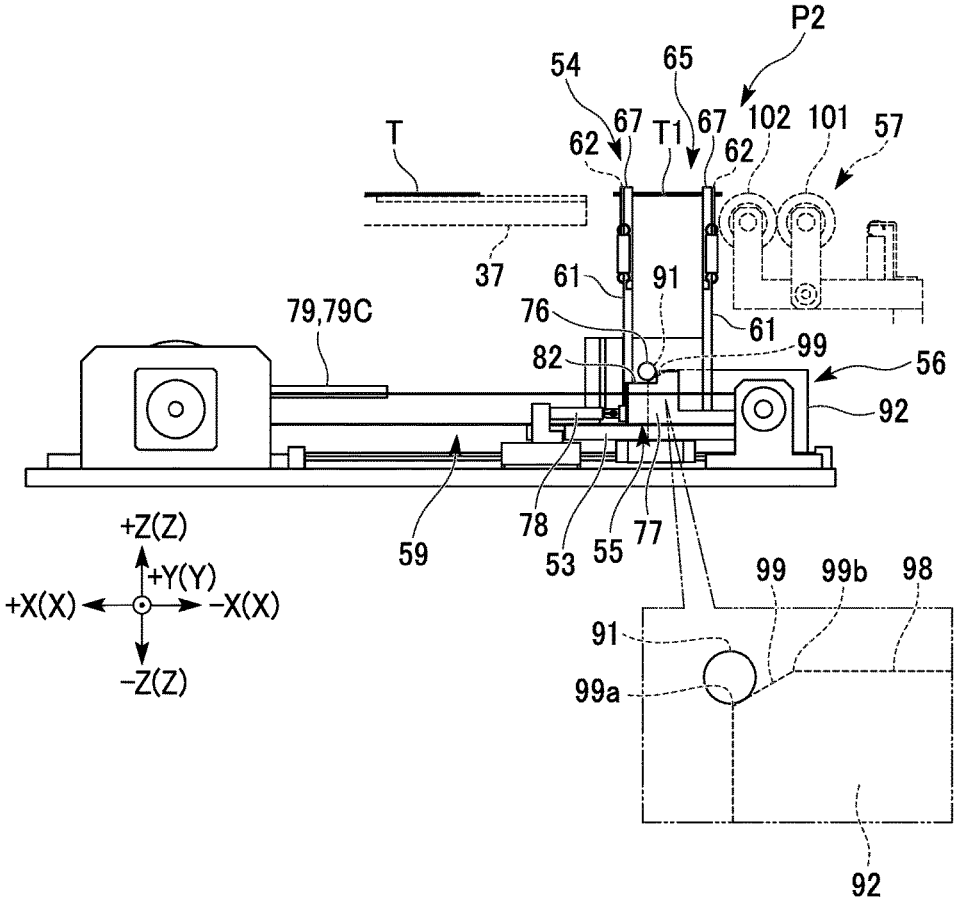
FIG. 16 is a front view showing an operation of the sheet binding device of the first embodiment.

Next, as shown in FIG. 16, the slide base 53 is caused to retract in the −X direction by use of the slide base moving mechanism 59, thereby causing the tape holder 54 holding the tape section T1, and the first displacement member 77 to retract in the −X direction.

Due to the retraction of the tape holder 54, the second projection 91 reaches the front end 99*a* (second portion) of the inclination 99 of the second displacement member 92.

Figure 17:
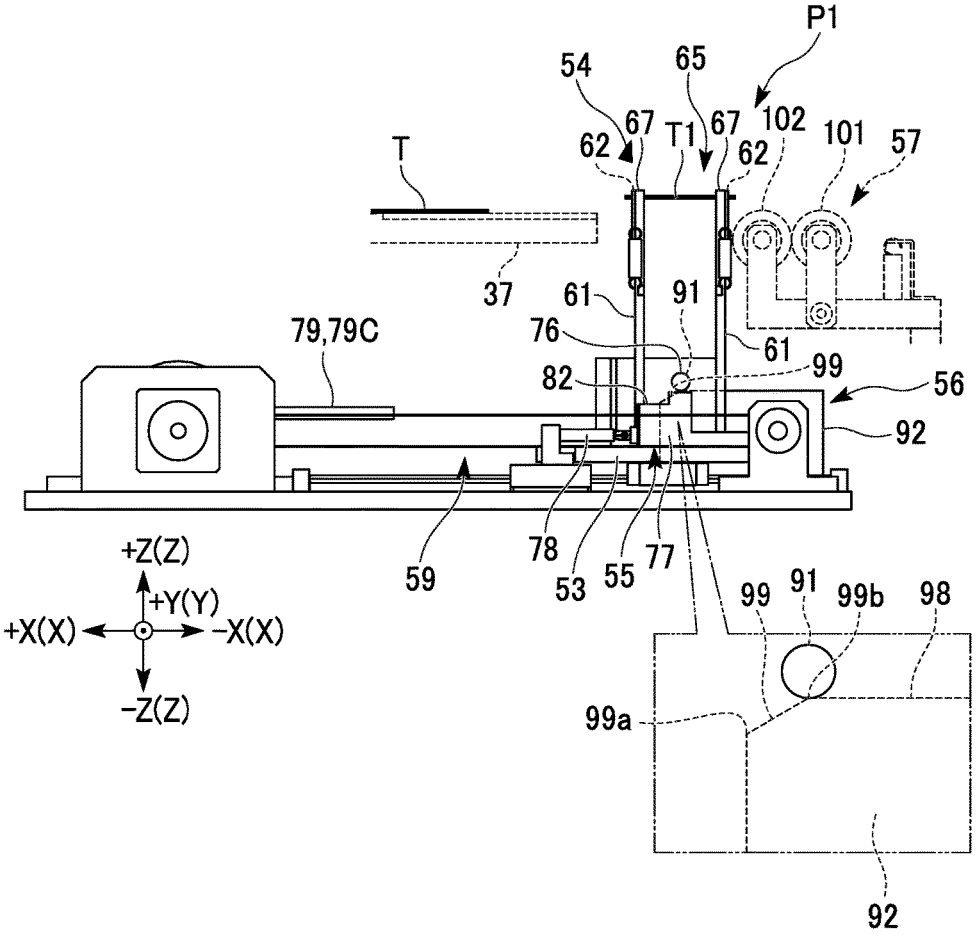
FIG. 17 is a front view showing an operation of the sheet binding device of the first embodiment.

As shown in FIG. 17, if the slide base 53 is caused to further retract, the second projection 91 is placed on the inclination 99 and rises according to an inclination thereof. The second projection 91 is displaced from the front end 99*a* (second portion) to the rear end 99*b* (first portion), and accordingly, the tape holder 54 rises from the second position P2 (lowered position) shown in FIG. 16 (moves in the +Z direction) and moves to the first position P1 (raised position) shown in FIG. 17.

As shown in FIG. 10, by the force-applying member 78, a force is applied to the first displacement member 77 in a forward direction (+X direction). Therefore, as shown in FIG. 17, when the first projection 76 rises due to the rise of the tape holder 54, the first displacement member 77 moves forward relative to the tape holder 54, and the first projection 76 returns to on the first stepped portion 81.

As shown in FIG. 17, in a process of causing the slide base 53 to further retract, the second projection 91 moves on the main portion 98. Since the main portion 98 has the same height as the rear end 99*b*, a height position of the tape holder 54 remains at the first position P1 (raised position).

Next, the position in the Y direction of the tape holder 54 is adjusted by the stage moving mechanism 58 and the tape holder 54 is arranged at a position at which the second tape receiver 65B (see FIG. 6) can receive the tape T. For example, in FIG. 6, the tape holder 54 is moved in the −Y direction. Thus, the position in the X direction of the tape holder 54 when the position in the Y direction of the tape holder 54 is adjusted is referred as to the tape processing position P4.

An arbitrary position in the X direction immediately before the tape holder 54 reaches the tape attacher 57 after the tape holder 54 is separated from the tape support base 37 can be the tape processing position P4.

The tape section T1 is received by use of the second holding bars 62B and 62B of the second tape receiver 65B in the same above-described procedure as when the tape section T1 is received by the first holding bars 62A and 62A of the first tape receiver 65A shown in FIG. 6.

Next, as shown in FIG. 18, the tape receiver 65 holding the tape section T1 is located above the tape attacher 57. Specifically, in a state in which the first tape receiver 65A and the second tape receiver 65B (see FIG. 6) hold the respective tape sections T1, the respective tape sections T1 are located above the pair of tape attachers 57. The tape sections T1 are arranged to straddle the first roller 101 and the second roller 102 when viewed from the +Z direction.

(Tape Attachment Step (Tape Processing Step))

As shown in FIG. 4, the sheet binding device 1 moves the stopper 32 to the restriction position (indicated by a two-dot chain line in FIG. 4) to restrict the movement of the sheet S conveyed to the main guide 31. Accordingly, the sheet bundle 5 is formed in a state in which the edges 5*a* are aligned.

Then, the sheet binding device 1 moves the stopper 32 to the release position (indicated by a solid line in FIG. 4).

Figure 19:
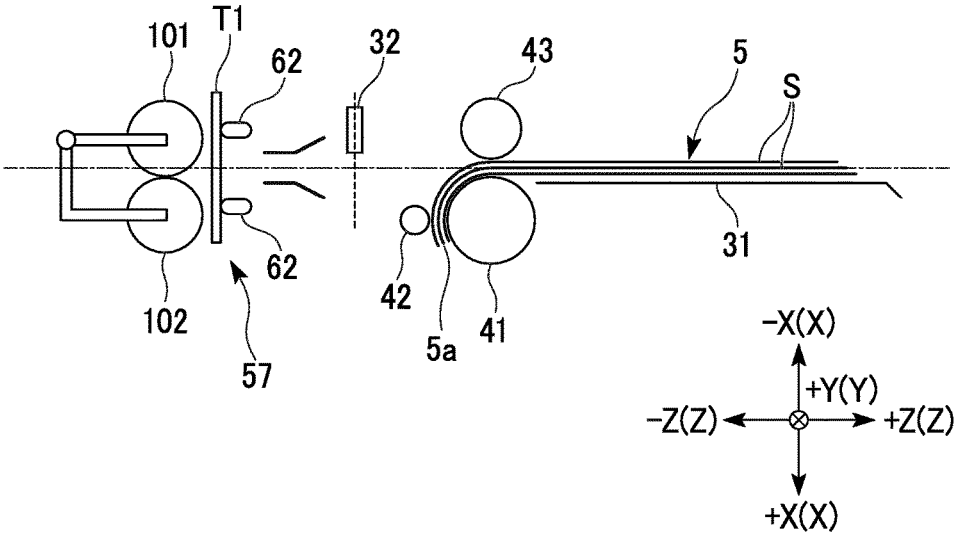
FIG. 19 is a front view schematically showing an operation of the sheet binding device of the first embodiment.

As shown in FIG. 19, the sheet binding device 1 rotates the driving roller 41 and the pressing roller 42 is pivoted with the sheet bundle 5 sandwiched between the pressing roller 42 and the driving roller 41 to perform a bending process of bending the sheet bundle 5.

Since the sheet bundle 5 is pivoted in a state in which the sheet bundle 5 is pressed by the pressing roller 42 and the edges 5*a* are aligned, displacement occurs among the sheets S according to a thickness of the sheet bundle 5.

Figure 20:
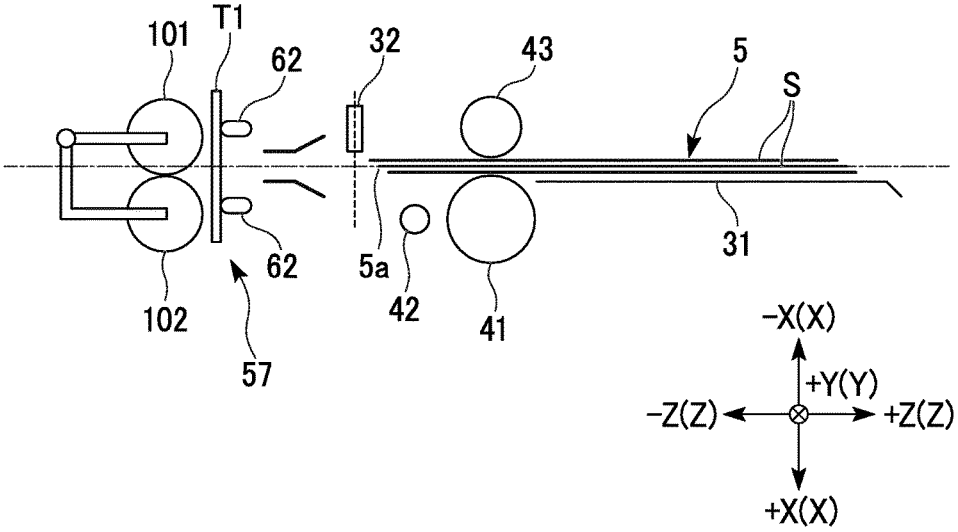
FIG. 20 is a front view showing an operation of the sheet binding device of the first embodiment.

As shown in FIG. 20, the pressing by the pressing roller 42 is released, the sheet bundle 5 is released, and the sheet S returns to an unbent state while the sheets S are displaced. Accordingly, a state in which the plurality of sheets S are displaced in a stepwise shape at the edge 5*a* of the sheet bundle 5 is formed.

Figure 21:
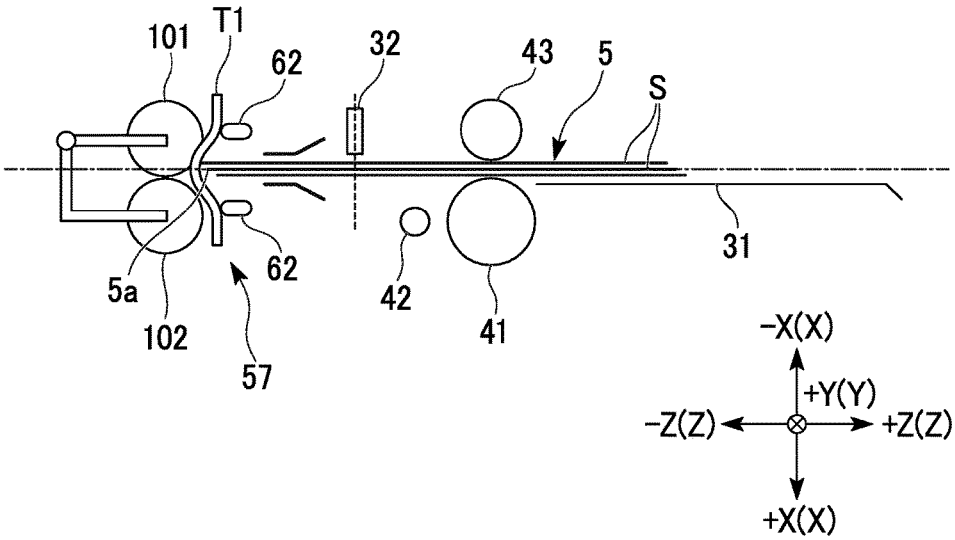
FIG. 21 is a front view showing an operation of the sheet binding device of the first embodiment.

As shown in FIG. 21, the sheet binding device 1 forward rotates, for example, the driving roller 41 and the driven roller 43 to move the sheet bundle 5 to the tape attacher 57. The sheet binding device 1 causes an end of the edge 5*a* of the sheet bundle 5 to come into contact with the tape section T1 and inserts the edge 5*a* of the sheet bundle 5 between the first roller 101 and the second roller 102 together with the tape section T1.

Figure 22:
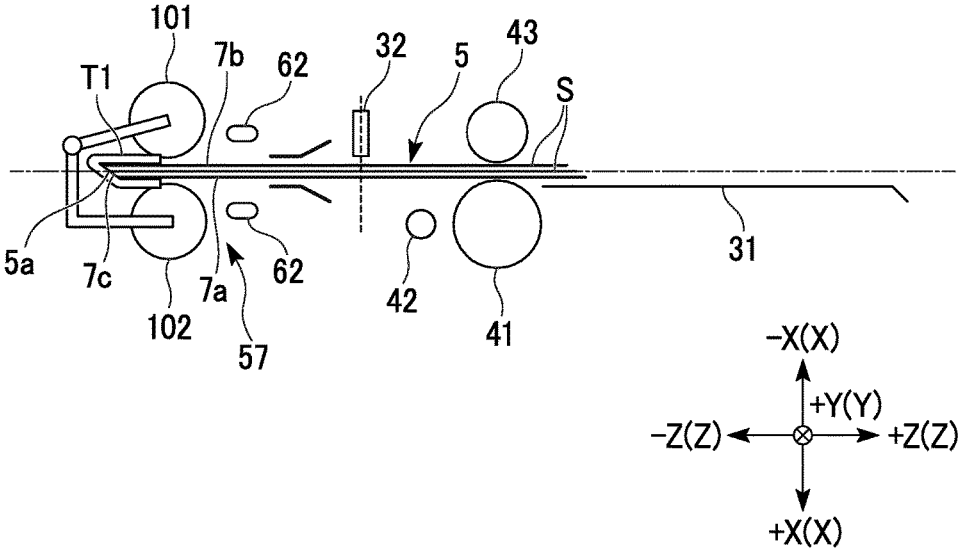
FIG. 22 is a front view showing an operation of the sheet binding device of the first embodiment.

In the case where the edge 5*a* of the sheet bundle 5 is inserted between the first roller 101 and the second roller 102 together with the tape section T1 as shown in FIG. 22, the first roller 101 moves along an outer shape of the edge 5*a* of the sheet bundle 5. Thus, the first roller 101 and the second roller 102 press the tape section T1 against the edge 5*a* of the sheet bundle 5. As a result, the tape section T1 sequentially follows and comes into close contact with a step-shaped portion of the sheet bundle 5.

The edge 5*a* of the sheet bundle 5 includes a first surface 7*a*, a second surface 7*b*, and an end surface 7*c*. The first surface 7*a* and the second surface 7*b* are surfaces in the sheet conveyance direction. The second surface 7*b* is located on the side opposite to the first surface 7*a*. The end surface 7*c* is located between the first surface 7*a* and the second surface 7*b*, and a plurality of sheets S are displaced in a stepwise manner. The sheet S is attached over the first surface 7*a*, the end surface 7*c*, and the second surface 7*b* at the edge 5*a* of the sheet bundle 5. Thus, all the sheets S including intermediate pages of the sheet bundle 5 are integrally integrated by the tape section T1. Accordingly, the process of attaching the tape section T1 to the edge 5*a* of the sheet bundle 5 is completed.

Figure 23:
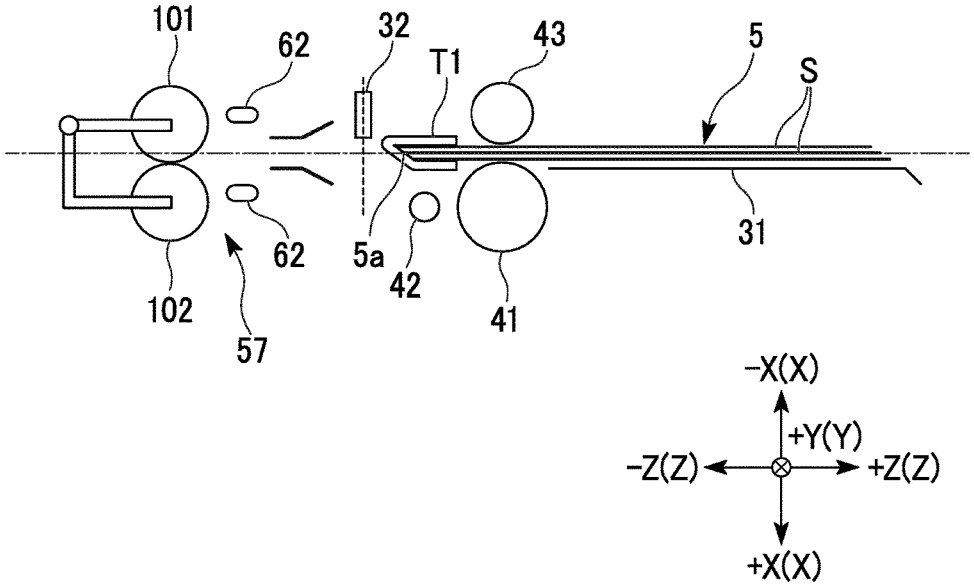
FIG. 23 is a front view showing an operation of the sheet binding device of the first embodiment.

Next, in the sheet binding device 1, the driving roller 41 and the driven roller 43 are reversely rotated to take out the sheet bundle 5 from between the first roller 101 and the second roller 102, as shown in FIG. 23. In the sheet binding device 1, the driving roller 41 and the driven roller 43 are further reversely rotated, such that the sheet bundle 5 can be discharged to the discharger of the sheet binding device 1 shown in FIG. 1.

Thus, a series of operations performed by the sheet binding device 1 end.

The sheet bundle 5 is reciprocated a plurality of times in a Z direction, such that the tape portion (a portion in which the tape section T1 is attached) can be pressed by the rollers 101 and 102 a plurality of times. Thus, the tape section T1 can be brought into close contact with the sheet bundle 5 and the sheet bundle 5 can be reliably bound.

Further, the tape portion of the sheet bundle 5 can be kept in a state in which the tape portion is pressed by the rollers 101 and 102 for a certain time. Thus, the tape section T1 can be brought into close contact with the sheet bundle 5, and the sheet bundle 5 can be reliably bound.

The sheet binding device 1 includes a first displacement mechanism 55 that moves the tape holder 54 from the first position P1 (raised position) to the second position P2 (lowered position) when the tape holder 54 reaches the tape reception position P3 (see FIG. 14). Therefore, the tape holder 54 is moved in the +X direction in a state in which the tape holder 54 is arranged at the first position P1 (raised position), it thereby being possible to prevent the holding bar 62 from coming into contact with the tape T on the tape support base 37. Further, the tape holder 54 is moved to the second position P2, thereby enabling it to receive the tape section T1.

Further, the sheet binding device 1 includes a second displacement mechanism 56 that moves the tape holder 54 from the second position P2 to the first position P1 until the tape holder 54 reaches the tape processing position P4.

With this configuration, it is not necessary for a driving source for moving the tape holder 54 between the first position P1 and the second position P2 to be separately provided in the sheet binding device 1. Therefore, it is possible to bind the sheet bundle 5 by use of a simple mechanism. Therefore, it is possible to reduce the size and the cost of the device.

According to the sheet binding device 1, since the tape attacher 57 is included, the tape section T1 can be attached to the sheet bundle 5.

In the first displacement mechanism 55, when the tape holder 54 reaches the tape reception position P3, the stopper 79 obstructs forward movement of the first displacement member 77, and accordingly, the first projection 76 can transition from the first stepped portion 81 to the second stepped portion 82 due to a weight of the tape holder 54.

Thus, it is possible to cause the tape holder 54 to transition from the first position P1 to the second position P2 by use of a simple mechanism in which a dedicated driving source is not used, and to reduce the size and the cost of the sheet binding device 1.

The second displacement mechanism 56 can displace the second projection 91 from the front end 99*a* (second portion) of the inclination 99 to the rear end 99*b* (first portion) until the tape holder 54 reaches the tape processing position P4.

Thus, it is possible to cause the tape holder 54 to transition from the second position P2 to the first position P1 by use of a simple mechanism in which a dedicated driving source is not used, and to reduce the size and the cost of the sheet binding device 1.

Since the sheet binding device 1 includes the stage moving mechanism 58 that moves the slide base 53 in the Y direction, it is possible to adjust the position in the Y direction of the tape receiver 65 according to the tape supply mechanism 50. Therefore, the tape receiver 65 can receive and hold a plurality of tape sections T1 at a plurality of different positions in the Y direction. Therefore, the sheet bundle 5 can be bound by the plurality of tape sections T1 by use of one tape supply mechanism 50 and without moving the sheet bundle 5.

Since the sheet binding device 1 includes the stage moving mechanism 58, a plurality of tape sections T1 can be held in the tape receiver 65 without moving the tape supply mechanism 50 which readily increases in size thereof due to a complicated structure. Therefore, it is possible to simplify the device configuration. Thus, it is possible to reduce a size of the sheet binding device 1. Further, it is possible to suppress power consumption and reduce costs.

Since the sheet binding device 1 includes a plurality of tape receivers 65 (65A and 65B) and a plurality of tape attachers 57 and 57, a plurality of tape sections T1 can be attached to the sheet bundle 5 by one operation. Therefore, it is possible to reduce the number of working steps and achieve efficiency of work and cost reduction, as compared with a case in which the plurality of tape sections T1 are attached to the sheet bundle 5 one by one. Therefore, it is possible to bind the sheet bundle 5 at low cost in a short time.

Further, since the sheet binding device 1 can attach the plurality of tape sections T1 to the sheet bundle 5 by one operation, it is difficult for displacement of attachment positions of the plurality of tape sections T1, or the like to occur. Therefore, this is also preferable in terms of an appearance, binding strength, or the like of the bound sheet bundle 5.

Since the tape supply mechanism 50 includes the tape conveyance roller 34 that sends the tape T to the tape support base 37, and the cutter 38 that cuts the tape T on the tape support base 37, the tape T supplied to the tape support base 37 can be cut and directly supplied as the tape sections T1 to the tape holder 54.

Since the tape sections T1 can be supplied by a simple mechanism, it is possible to simplify the device configuration. Therefore, it is possible to reduce the size and the cost of the sheet binding device 1.

As shown in FIG. 1, even when the sheet binding device 1 is used as a sheet post-processing device that performs post-processing on the sheet S conveyed from the image former 2, it is possible to reduce the size and the cost of the device.

Since the image forming apparatus 3 shown in FIG. 1 includes the sheet binding device 1, it is possible to reduce the size and the cost.

Second Embodiment

A second embodiment will be described with reference to FIG. 24.

Figure 24:
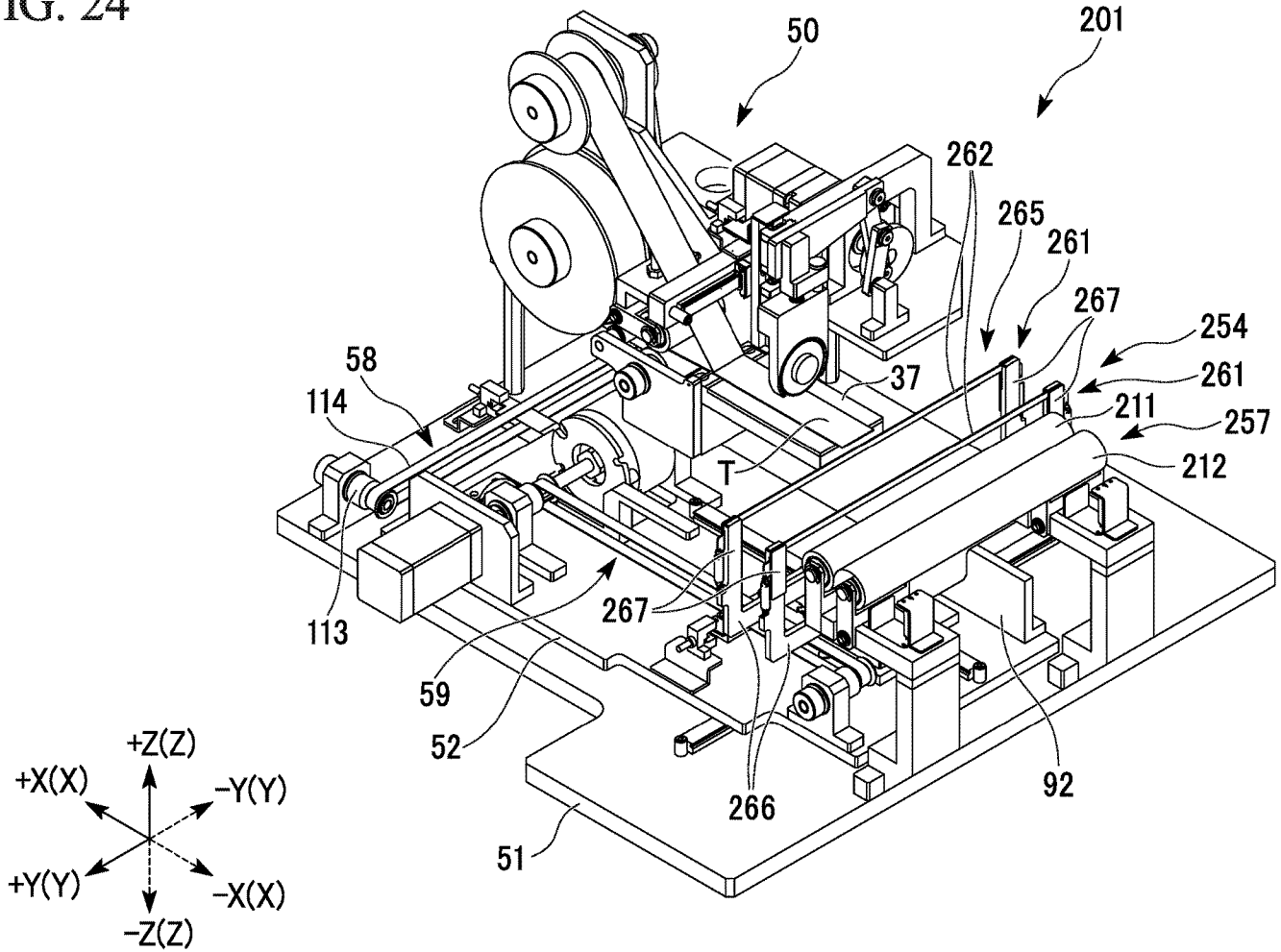
FIG. 24 is a perspective view showing an internal configuration of a sheet binding device of a second embodiment.

FIG. 24 is a perspective view showing an internal configuration of a sheet binding device 201 of the second embodiment.

The sheet binding device 201 of the second embodiment is different from the sheet binding device 1 of the first embodiment shown in FIG. 6 in that one tape receiver 265 and one tape attacher 257 of which dimensions in the Y direction are large are included.

The support member 261 of the tape holder 254 of the sheet binding device 201 shown in FIG. 24 includes a base body 266 and a pair of struts 267 and 267. The holding bar 262 bridges between the struts 267 and 267. The struts 267 and 267 and the holding bar 262 constitute the tape receiver 265.

A spacing distance between the struts 267 and 267 is greater than a distance between the first pair of struts 67A and 67A and a distance between the second pair of struts 67B and 67B in the sheet binding device 1 of the first embodiment shown in FIG. 6. Therefore, the holding bar 262 shown in FIG. 24 is longer than the holding bar 62 in the sheet binding device 1 shown in FIG. 6.

The sheet binding device 201 includes one tape attacher 257. The first roller 211 and the second roller 212 constituting the tape attacher 257 have a greater dimension in the Y direction than the first roller 101 and the second roller 102 in the sheet binding device of the first embodiment.

Thus, the sheet binding device 201 includes the tape receiver 265 having a large dimension in the Y direction, and the tape attacher 257 having a large dimension in the Y direction.

In the sheet binding device 201, the tape sections can be attached to the sheet bundle 5 in the following procedure.

The tape section is received in a first portion in a longitudinal direction (Y direction) of the holding bar 262 of the tape receiver 265, as in the sheet binding device 1 of the first embodiment.

Then, after the tape holder 254 is moved in the Y direction by the stage moving mechanism 58, the tape section is received in a second portion (a portion different from the first portion) in the longitudinal direction (Y direction) of the holding bar 262 of the tape receiver 265 in the same procedure. Thus, a plurality of tape sections can be held in different portions of the holding bar 262.

Then, the tape sections are attached to the edge of the sheet bundle, as in the sheet binding device 1 of the first embodiment.

The number of tape sections held in the holding bar 262 may be not only 2, but also 1 or an arbitrary number equal to or greater than 3.

In the sheet binding device 201, the tape sections can be held in arbitrary positions in the holding bars 262 by the stage moving mechanism 58. Therefore, positions, the number thereof, or the like of attachment of the tape sections to the sheet bundle is less limited. Therefore, the positions, the number thereof, or the like of attachment of the tape sections to the sheet bundle can be freely selected according to a size, a thickness, or a material of the sheet, the number of sheets to be bound, or the like.

In the sheet binding device 201, since the dimension in the Y direction of the tape receiver 265 is large, the tape holder 254 can be moved in the Y direction in a state in which the holding bar 262 is on the tape support base 37. Therefore, a configurations of the tape attacher 257, the second displacement member 92, or the like can be arranged to be shifted in the +X direction, as compared with the sheet binding device 1 of the first embodiment, and thus, it is possible to reduce a size of the device.

The configuration of the embodiment is not limited to the above example. For example, the sheet binding device 1 may be an independently used device regardless of the image former 2.

Although the sheet binding device 1 of the first embodiment includes the two tape receivers 65 and the two tape attachers 57, the number of tape receivers 65 and tape attachers 57 may be an arbitrary number equal to or greater than 3.

Although the first displacement mechanism 55 in the sheet binding device 1 has a structure in which the first projection 76 is shifted from the first stepped portion 81 to the second stepped portion 82 due to the weight of the tape holder 54, a structure in which the first projection is shifted from the first stepped portion to the second stepped portion due to a biasing force of a force-applying member such as a spring may be adopted.

According to at least an embodiment described above, the first displacement mechanism 55 that moves the tape holder 54 from the first position P1 to the second position P2 when the tape holder 54 receives the tape section T1, and the second displacement mechanism 56 that moves the tape holder 54 from the second position P2 to the first position P1 when the tape holder 54 is moved so that the tape holder 54 is separated from the tape support base 37 are included. Accordingly, it is possible to bind the sheet bundle by use of a simple mechanism. Therefore, it is possible to reduce a size and a cost of the device.

If the dimension in the Y direction of the tape receiver 265 is sufficiently large, the tape holder 254 can be moved in the Y direction in a state in which the holding bar 262 is on the tape support base 37. Therefore, it is possible to arrange a configuration of the tape attacher 257, the second displacement member 92, or the like so that the configuration is shifted in the +X direction, and to reduce the size of the device.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

For example, a moving direction of the tape holder when the tape holder is displaced from the first position to the second position by the first displacement mechanism is not particularly limited, and may be the second direction or may be a direction inclined with respect to the second direction. Similarly, a moving direction of the tape holder when the tape holder is displaced from the second position to the first position by the second displacement mechanism is not particularly limited, and may be the second direction or may be a direction inclined with respect to the second direction.

What is claimed is:

1. A sheet binding device, comprising:

a tape support base that supports a tape;

a slide base that is movable in a first direction;

a tape holder that is supported on the slide base and is movable in a second direction crossing the first direction;

a first displacement mechanism that displaces the tape holder in the second direction from a first position that is a position away from the tape to a second position at which the tape holder is capable of coming into contact with the tape when the tape holder and the slide base move in the first direction toward the tape support base and receives the tape; and a second displacement mechanism that displaces the tape holder in the second direction from the second position to the first position when the tape holder and the slide base move in the first direction in which the tape holder becomes far from the tape support base.

2. The sheet binding device according to claim 1, further comprising:

a tape attacher that attaches the tape held in the tape holder to an edge of a sheet bundle including a plurality of sheets.

3. The sheet binding device according to claim 1, wherein the first displacement mechanism comprises:

a first projection provided in the tape holder;

a first displacement member comprising a first stepped portion and a second stepped portion lower than the first stepped portion;

a force-applying member that applies a force to the first displacement member; and a stopper that is capable of coming into contact with the first displacement member, and the tape holder is arranged at the first position when the first projection is placed on the first stepped portion, and is arranged at the second position when the first projection is placed on the second stepped portion, and the stopper comes into contact with the first displacement member when the tape holder receives the tape to displace the first projection placed on the first stepped portion onto the second stepped portion.

4. The sheet binding device according to claim 1, wherein the second displacement mechanism comprises: a second projection provided in the tape holder; and a second displacement member comprising an inclination having a height increasing gradually from a second portion to a first portion, the tape holder is arranged at the second position when the second projection is placed at the second portion and is arranged at the first position when the second projection is placed at the first portion, and the second displacement member displaces the second projection from the second portion to the first portion when the tape holder moves in a direction in which the tape holder becomes far from the tape support base.

5. The sheet binding device according to claim 1, wherein the slide base is movable in a third direction crossing the first direction and the second direction.

6. The sheet binding device according to claim 5, wherein the tape holder comprises a tape receiver that comes into contact with the tape on the tape support base to receive the tape, and a plurality of tape receivers and a plurality of tape attachers are provided in the third direction.

7. The sheet binding device according to claim 1, further comprising:

a tape feeder that feeds the tape toward the tape support base; and a cutter that cuts the tape on the tape support base.

8. The sheet post-processing device, comprising:

the sheet binding device according to claim 1.

9. An image forming apparatus, comprising:

an image former that forms an image on a sheet, and the sheet post-processing device according to claim 8.

* * * * *